US010458092B1

(12) United States Patent
Correia et al.

(10) Patent No.: US 10,458,092 B1
(45) Date of Patent: Oct. 29, 2019

(54) MODULAR RETAINING WALL SYSTEM AND FAçADE

(71) Applicant: Horacio Correia, Terrebonne (CA)

(72) Inventors: Horacio Correia, Terrebonne (CA); Liborio Correia, Terrebonne (CA); Simon Jean, Terrebonne (CA); Marco Santos, Terrebonne (CA)

(73) Assignee: Horacio Correia, Terrebonne, Quebec (CA)

( * ) Notice: Subject to any disclaimer, the term of this patent is extended or adjusted under 35 U.S.C. 154(b) by 0 days.

(21) Appl. No.: 16/001,892

(22) Filed: Jun. 6, 2018

(51) Int. Cl.
*E02D 29/02* (2006.01)

(52) U.S. Cl.
CPC ..... *E02D 29/025* (2013.01); *E02D 29/0266* (2013.01); *E02D 2300/002* (2013.01); *E02D 2600/20* (2013.01)

(58) Field of Classification Search
CPC ..... E02D 29/025; E02D 29/0266
See application file for complete search history.

(56) References Cited

U.S. PATENT DOCUMENTS 5,474,405 A * 12/1995 Anderson ..... B29C 49/2408 405/262
5,735,643 A * 4/1998 Castonguay ..... E02D 29/0266 405/284
5,788,423 A * 8/1998 Perkins ..... E02D 29/025 405/284
5,820,304 A * 10/1998 Sorheim ..... E02D 29/0233 405/286
6,024,517 A * 2/2000 Castonguay ..... E02D 29/0266 125/2
6,062,772 A * 5/2000 Perkins ..... E02D 29/025 405/284
6,336,773 B1 * 1/2002 Anderson ..... E02D 29/02 405/262
7,410,328 B2 * 8/2008 Hamel ..... E02D 29/0266 405/262
7,806,038 B2 * 10/2010 Duke ..... E04B 2/06 89/36.01
7,854,573 B2 * 12/2010 Knudson ..... E02D 29/02 405/262
8,656,678 B2 * 2/2014 MacDonald ..... E02D 29/025 52/562
8,992,131 B2 * 3/2015 Castonguay ..... E02D 29/0225 405/284
9,670,640 B2 * 6/2017 Castonguay ..... E02D 29/025
(Continued)

FOREIGN PATENT DOCUMENTS

CA 2755112 A1 * 3/2013 ..... E02D 29/025

*Primary Examiner* — Frederick L Lagman
(74) *Attorney, Agent, or Firm* — Praxis

(57) ABSTRACT

A retaining wall system comprises at least one rear supporting block, at least one façade block and at least one connector. The retaining wall system comprises top and bottom surfaces and a peripheral surface therebetween defining receiving slots on at least a portion thereof. The façade block comprises front and rear surfaces, top and bottom ends, and lateral side. The top and bottom ends define respective receiving slots. The connector comprises a rear portion for being fitted into the receiving slot of the rear supporting block and a front portion for being fitted into the receiving slot of the façade block. The connector provides for connecting the façade block to the rear supporting block.

15 Claims, 25 Drawing Sheets

(56) References Cited

U.S. PATENT DOCUMENTS

| | | | | |
|---|---|---|---|---|
| 9,890,512 | B2 * | 2/2018 | Castonguay | E02D 29/0225 |
| 2007/0245678 | A1 * | 10/2007 | Bonelli | E04B 1/4185 52/698 |
| 2008/0313988 | A1 * | 12/2008 | MacDonald | E02D 29/02 52/385 |
| 2009/0041552 | A1 * | 2/2009 | Hammer | E02D 29/0225 405/284 |
| 2010/0018146 | A1 * | 1/2010 | Aube | E02D 29/0233 52/483.1 |
| 2011/0072753 | A1 * | 3/2011 | MacDonald | E02D 29/025 52/562 |
| 2012/0063853 | A1 * | 3/2012 | Bott | E02D 29/025 405/284 |
| 2012/0073229 | A1 * | 3/2012 | Castonguay | E02D 29/0225 52/426 |
| 2014/0260029 | A1 * | 9/2014 | Browning | E04C 1/41 52/309.4 |
| 2015/0071715 | A1 * | 3/2015 | Hammer | E02D 29/0233 405/286 |
| 2015/0159339 | A1 * | 6/2015 | Castonguay | E02D 29/0225 405/284 |
| 2015/0247328 | A1 * | 9/2015 | Correia | E04C 1/00 52/489.2 |
| 2016/0069078 | A1 * | 3/2016 | MacDonald | E02D 29/025 52/506.05 |
| 2016/0130780 | A1 * | 5/2016 | Castonguay | E02D 29/025 405/284 |
| 2018/0023303 | A1 * | 1/2018 | MacDonald | E04F 13/0801 |

* cited by examiner

MODULAR RETAINING WALL SYSTEM AND FAçADE

CROSS-REFERENCE TO RELATED APPLICATIONS

The present application claims priority on U.S. Provisional Patent Application No. 62/516,085, filed on Jun. 6, 2017 and incorporated herein by reference in its entirety.

TECHNICAL FIELD

The present disclosure relates to building blocks such as cementitious blocks and the like. More particularly, but not exclusively, the present disclosure relates to modular retaining wall system for façade.

BACKGROUND

Retaining walls are structures designed to restrain soil to a slope that it would not naturally keep to. These walls are usually a freestanding structure without lateral support that lean along the slope of the soil or along the vertical fill between the soil and the wall. Retaining walls are used to bound soils between two different elevations often in areas of terrain possessing undesirable slopes or in areas where the landscape needs to be shaped for more specific purposes. A retaining wall is a structure that resists the lateral pressure of soil, when there is a desired change in ground elevation that exceeds the angle of repose of the soil. In many cases, it is desired to build a façade to cover the retaining wall for aesthetic purposes. The façade sometimes has a sloped appearance due to the sloped configuration of the retaining wall along the slope of the soil or fill. There are many time consuming, labor intensive, difficult and cumbersome building techniques to minimize the sloped appearance of the façade. Many of these building techniques are avoided due to costs and difficulty and as such, a less than desirable façade is produced.

OBJECTS

An object of the present disclosure is to provide a modular retaining wall system for a façade.

An object of the present disclosure is to provide a retaining wall system.

An object of the present disclosure is to provide a kit for a retaining wall system.

An object of the present disclosure is to provide a retaining wall.

An object of the present disclosure is to provide a method for a retaining wall system.

An object of the present disclosure is to provide a connector for a retaining wall system.

SUMMARY

In accordance with an aspect of the present disclosure, there is provided a retaining wall system comprising: at least one rear supporting block comprising top and bottom surfaces and a peripheral surface therebetween defining receiving slots on at least a portion thereof; at least one façade block comprising front and rear surfaces, top and bottom ends, and lateral sides, the top and bottom ends; at least one connector comprising: a rear portion for being fitted into the receiving slot of the rear supporting block; a front portion for being connected to the top or bottom end of the façade block; and a longitudinal body interposed between the front and rear portions, wherein the connector provides for connecting the façade block to the rear supporting block.

In an embodiment, the slots of the rear supporting block are defined by spaced apart finger portions. In an embodiment, the wall retaining system further comprises at least a second one of the rear supporting block, wherein the slots of the at least one rear supporting block receive the finger portions of the second one of the rear supporting block and wherein the finger portions of the at least one rear supporting block are received by the slots of the second one of the rear supporting block. In an embodiment, the wall retaining system further comprises a plurality of the rear supporting block, wherein a given one of the plurality of the rear supporting block can be connected to another given one of the plurality of the rear supporting block along the respective peripheries thereof.

In an embodiment, the periphery of the rear supporting block comprises front and rear end sides and opposite lateral sides. In an embodiment, the front, rear and opposite lateral sides define spaced apart finger portions that define the slots of the at least one rear supporting block.

In an embodiment, the front portion is rotatable relative to the longitudinal body.

In an embodiment, the distance between the front portion and the rear portion is selectively adjustable in order to selectively adjust the distance between the façade block and the rear supporting block.

In an embodiment, the length of the longitudinal body is selectively adjustable in order to selectively adjust the distance between the façade block and the rear supporting block.

In an embodiment, the rear portion comprises lateral walls for mating with the respective interfacing walls of the adjacent fingers that define the slot.

In an embodiment, at least one the front and rear ends of the connector is movable.

In an embodiment, the wall retaining system further comprises at least a second one of the façade block for being stacked at the bottom end thereof on the top end of the at least one façade block thereby defining upper and lower façade block, wherein the front end of the connector is connectable to the bottom end of the upper façade block and the top end of the lowed façade block.

In an embodiment, at least one of the top and bottom ends of the façade block defines a slot, the front end of the connector being fitted within the slot of the façade block.

In an embodiment, the top and bottom surfaces of the rear supporting block define respective grooves for receiving the connector, the system further comprising at least a second one of the rear supporting block stackable on the at least one rear supporting block thereby defining upper and lower rear supporting blocks, wherein the connector is interposable therebetween for providing an offset between the upper and lower rear supporting blocks.

In accordance with an aspect of the disclosure, there is provided a kit for a retaining wall system comprising: a plurality of rear supporting blocks, each rear supporting block comprising top and bottom surfaces and a peripheral surface therebetween defining receiving slots on at least a portion thereof; a plurality of rear supporting blocks, each façade block comprising front and rear surfaces, top and bottom ends, and lateral sides; a plurality of rear connectors, each rear connector comprising a rear end for being fitted into the receiving slot of a given rear supporting block and a front end for being connected to the top or bottom end of a given façade block positioned in front of the given rear supporting block, wherein the connector provides for connecting the façade block to the rear supporting block.

In accordance with an aspect of the disclosure, there is provided a retaining wall comprising: at least one rear supporting block comprising top and bottom surfaces and a peripheral surface therebetween defining receiving slots on at least a portion thereof; at least one façade block comprising front and rear surfaces, top and bottom ends, and lateral sides; at least one connector comprising a rear end for being fitted into the receiving slot of the rear supporting block and a front end for connected to the top or bottom end of a given façade block positioned, wherein the connector provides for connecting the façade block to the rear supporting block.

In accordance with an aspect of the disclosure, there is provided a method for providing a retaining wall, the method comprising: providing at least one rear supporting block comprising top and bottom surfaces and a peripheral surface therebetween defining receiving slots on at least a portion thereof; providing at least one façade block comprising front and rear surfaces, top and bottom ends, and lateral sides, the top and bottom ends defining respective receiving slots; providing at least one connector comprising a rear end for being fitted into the receiving slot of the rear supporting block and a front end for being fitted into the receiving slot of the façade block; positioning the at least one façade block in front of the rear supporting block; fitting the rear end of the connector into the receiving slot of the rear supporting block; and connecting the front end to the upper or bottom end the façade block thereby connecting the façade block to the rear supporting block.

In accordance with an aspect of the disclosure, there is provided a rear support block for a retaining wall comprising: top and bottom surfaces and a periphery therebetween defining front and rear faces and opposite lateral sides; a plurality of finger portions protruding from at least a portion of the periphery, a given pair of adjacent fingers defining a slot therebetween, the slot providing for: (i) receiving a connector being connected to a façade block positioned in front of the rear support block, and (ii) receiving finger portions of another rear support block. In an embodiment, at least one of the top and bottom surfaces defines a groove for receiving a connector.

In accordance with an aspect of the disclosure, there is provided a connector for connecting a front façade block to a rear support block, the front façade block having front and rear surfaces, top and bottom ends, and lateral sides, the rear support block having the top and bottom surfaces and a periphery therebetween, a plurality of finger portions protruding from at least a portion of the periphery, a given pair of adjacent fingers having respective interfacing walls that defining a slot therebetween, the connector comprising: a rear portion for being fitted within the slot of the rear support block; a front portion for being mounted to the top or bottom end of the front façade block; and a longitudinal body between the front and the rear portions.

In an embodiment of the connector, the front portion is rotatable relative to the longitudinal body. In an embodiment of the connector, the distance between the front portion and the rear portion is selectively adjustable. In an embodiment of the connector, the length of the longitudinal body is selectively adjustable. In an embodiment of the connector, the rear portion comprises lateral walls for mating with the respective interfacing walls of the adjacent fingers that define the slot. Other objects, advantages and features of the present disclosure will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where.

DETAILED DESCRIPTION OF ILLUSTRATIVE EMBODIMENTS

Generally stated and in accordance with an embodiment, there is provided a retaining wall system comprising at least one rear supporting block, at least one façade block and at least one connector. The retaining wall system comprises top and bottom surfaces and a peripheral surface therebetween defining receiving slots on at least a portion thereof. The façade block comprises front and rear surfaces, top and bottom ends, and lateral side. The connector comprises a rear portion for being fitted into the receiving slot of the rear supporting block and a front portion for being connected to the top or bottom end of the façade block. The connector provides for connecting the façade block to the rear supporting block.

With reference to the appended drawings, illustrative embodiments of the present disclosure will be described herein so as exemplify the disclosure and by no means limit the scope thereof.

Figure 1:
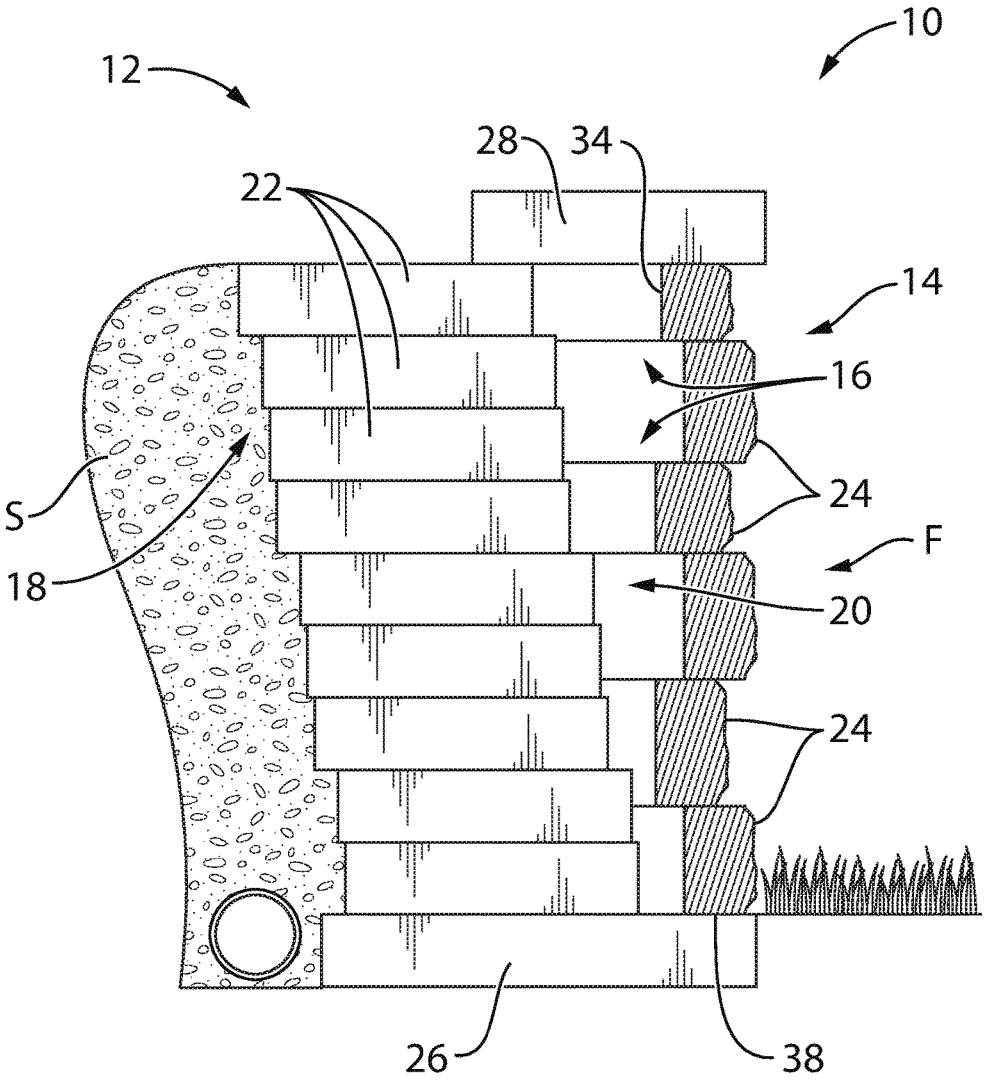
FIG. 1 is a side view of a modular retaining wall system in accordance with a non-restrictive illustrative embodiment of the present disclosure including a rear supporting wall structure leaning along the slope of the soil with a wall façade structure connected thereto via connectors interposed therebetween.

FIG. 1 shows a wall retaining system 10 comprising a rear retaining wall structure 12 and façade wall structure 14 connected thereto via connectors 16 interposed therebetween. More specifically, the rear retaining wall structure 12 defines a rear side 18 which leans along the slope of the soil S and receives at its front side 20 the connectors 16 being connected to the façade wall structure 14.

The rear retaining wall structure 12 consists of vertically stacked rear support block 22. The façade wall structure 14 consists of vertically stacked façade blocks 24.

The wall retaining system 10 includes a bottom support block 26 on which the interconnected rear retaining wall structure 12 and façade wall structure 14 stand on. A top capping block 28 rests on the top of the interconnected rear retaining wall structure 12 and façade wall structure 14.

Figure 2:
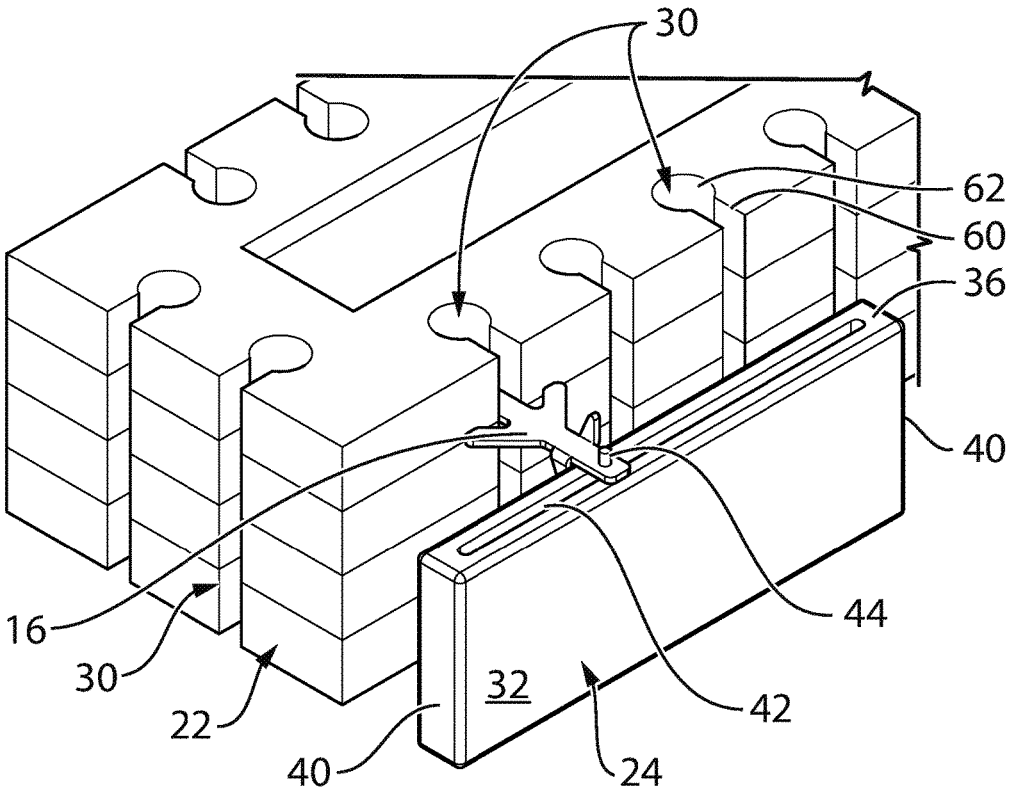
FIG. 2 is a top and front perspective view of a façade block connected to a rear supporting block in accordance with a non-restrictive illustrative embodiment of the present disclosure.

Turning to FIG. 2, the block 22 defines slots 30 for receiving the connector 16 which is connectable to the façade block 24. The façade block 24 defines front and rear faces, 32, and 34 (see FIG. 1), respectively, top and bottom ends 36 and 38 (see FIG. 1), respectively, and opposite lateral side 40. The top and/or bottom ends, 36 and 38, includes a groove 42 for receiving a fastener 44 such as a pin member through the connector 16.

Figure 3A:
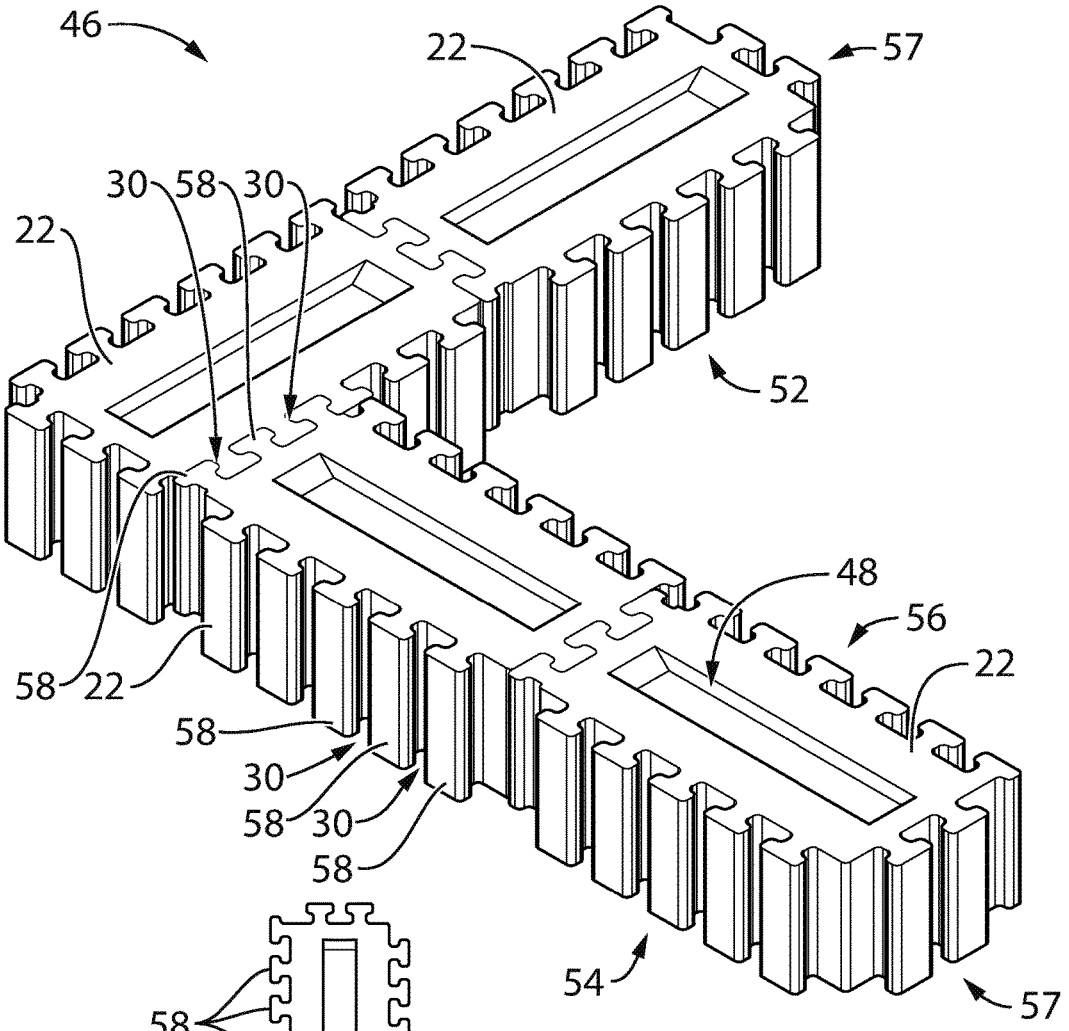
FIG. 3A is a top perspective views of an interconnected arrangement for rear supporting blocks for providing a rear supporting wall structure in accordance with a non-restrictive illustrative embodiment of the present disclosure.
Figure 3B:
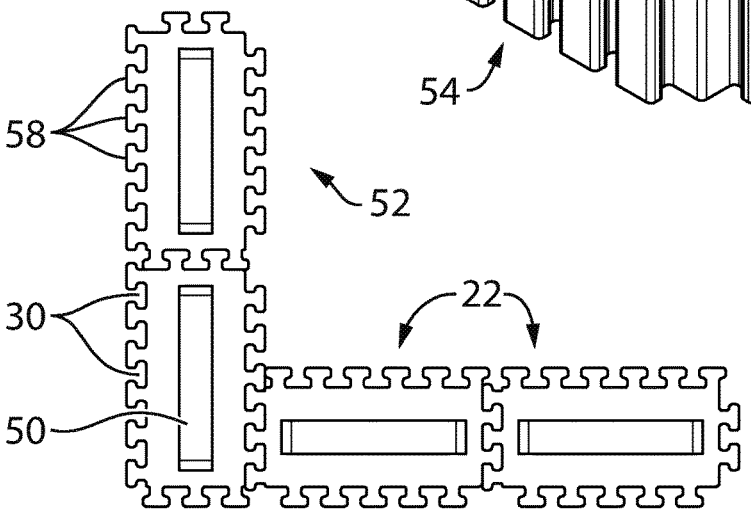
FIG. 3B is bottom plan view of the arrangement of FIG. 3A.

Regarding FIGS. 3A and 3B, there is shown an interconnected arrangement or assembly 46 of blocks 22. As shown, each block 22 defines top and bottom surfaces 48 and 50, respectively as well as a periphery 52 therebetween. The periphery 52 defines front and rear sides 54 and 56, respectively as well as lateral sides 57. The slots 30 are formed along the periphery 52 of the block 22 and are defined by spaced apart fingers 58.

With reference to FIGS. 2, 7A, 9C, and 9D each slot 30 defines a forward tunnel portion 60 and rearward larger end portion 62. Each finger 58 is a mirror image of the slot configuration. As such, adjacent blocks 22 are interconnected with the fingers 58 are fitted within the slots of the other and vice versa.

Figure 7A:
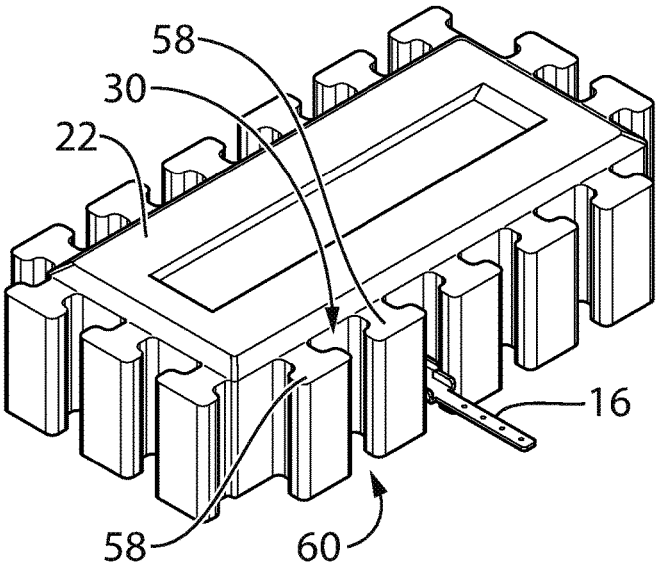
FIG. 7A is a perspective view of rear supporting block arrangements and connectors for providing a configuration of a modular retaining wall system in accordance with a non-restrictive illustrative embodiment of the present disclosure.
Figure 7B:
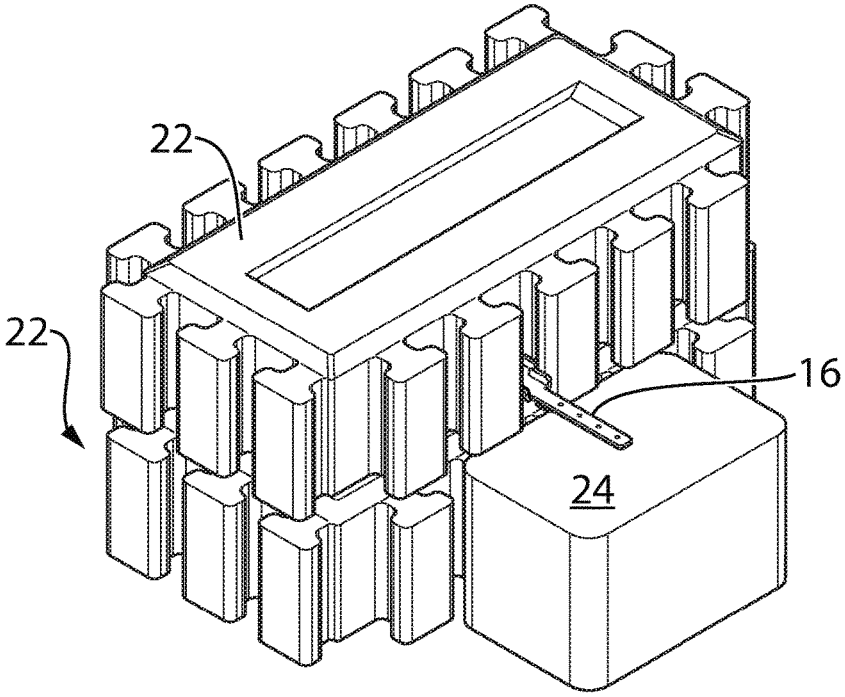
FIG. 7B is a perspective view of rear supporting block arrangements and connectors for providing a configuration of a modular retaining wall system in accordance with a non-restrictive illustrative embodiment of the present disclosure.
Figure 7C:
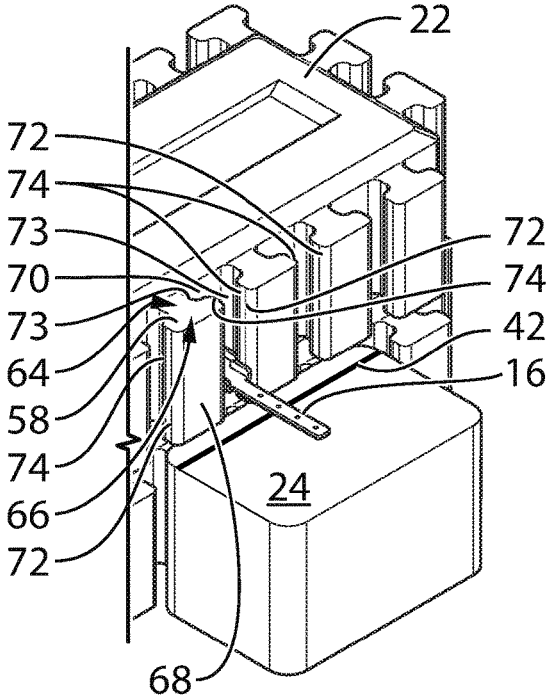
FIG. 7C is a perspective view of rear supporting block arrangements and connectors for providing a configuration of a modular retaining wall system in accordance with a non-restrictive illustrative embodiment of the present disclosure.
Figure 7D:
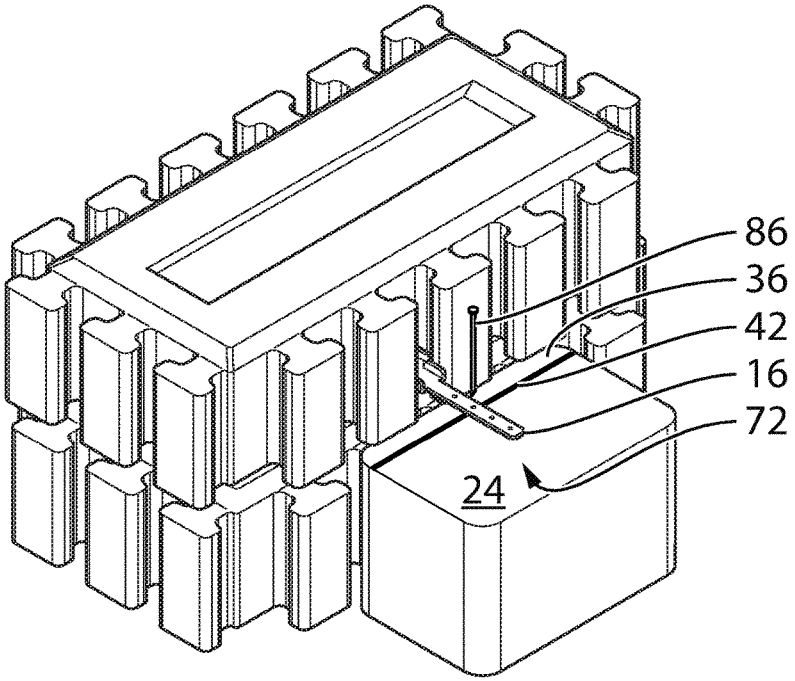
FIG. 7D is a perspective view of rear supporting block arrangements and connectors for providing a configuration of a modular retaining wall system in accordance with a non-restrictive illustrative embodiment of the present disclosure.

With particular reference to FIG. 7C, a finger 58 has a proximal portion 64 protruding from the block 22 and a distal head portion 66 extending form the proximal portion 64. The head 66 defining a front surface 68 for mating with a back wall 70 of the slot 30. The head 66 defines lateral end sides 72 which also define shoulders 74. Side walls 73 are formed between the back wall 70 and the shoulders 74.

As such, the blocks 22 and like blocks described herein can be interconnected together by their mutually mating peripheral fingers and slots in order to provide a variety of arrangements as shown throughout 3A-4 and 8A-9F.

Figure 4:
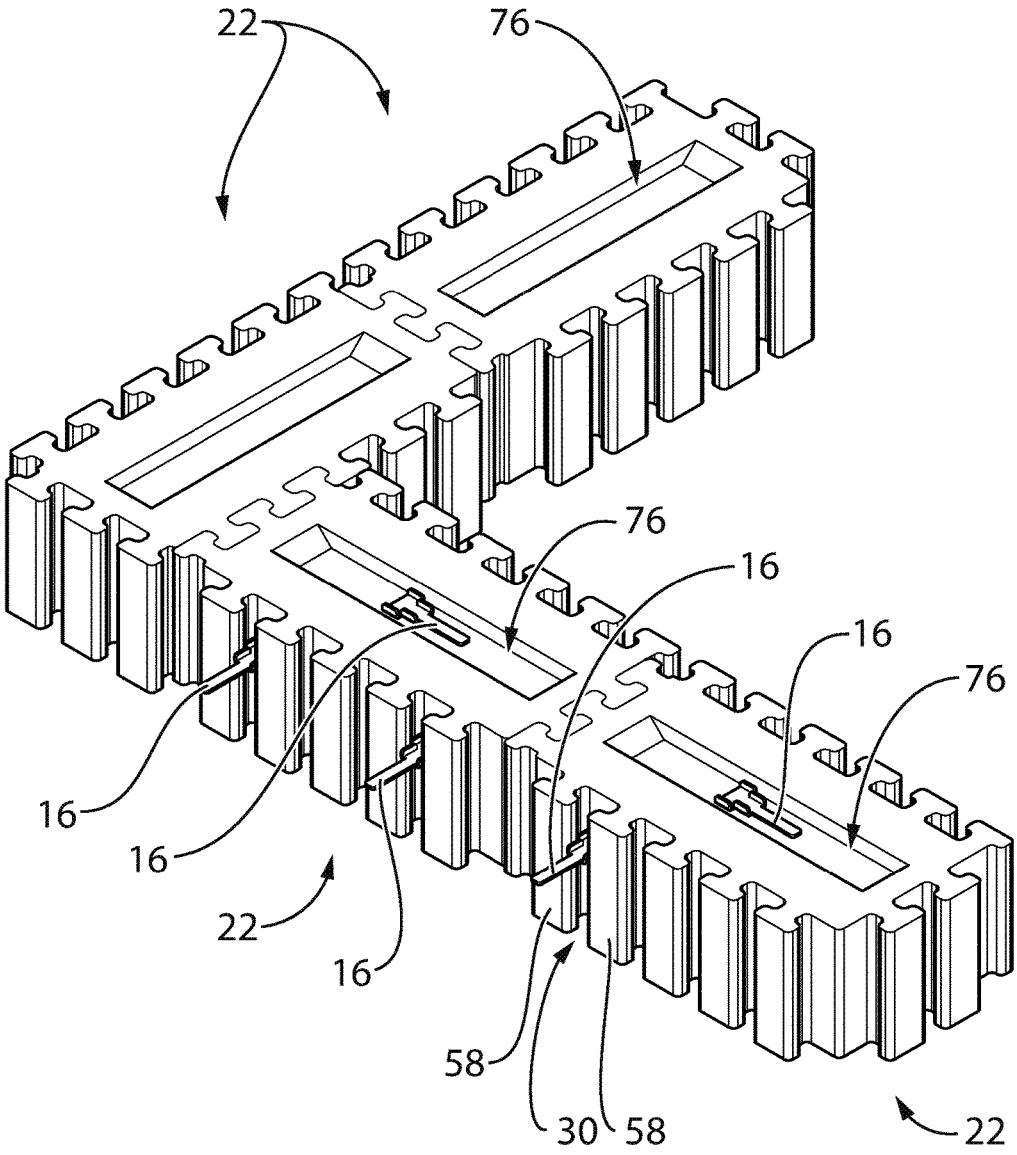
FIG. 4 is a front and top perspective view of an interconnected arrangement of rear supporting blocks with connectors mounted thereto for providing a rear supporting wall structure in accordance with a non-restrictive illustrative embodiment of the present disclosure.

FIGS. 3A, 3B and 4, show the blocks 22 include a groove 76 on their top and bottom surfaces 48 and 50, respectively.

FIGS. 4 and 7A to 7D show the connector system 10 including the connector or connectors 16.

Figure 7E:
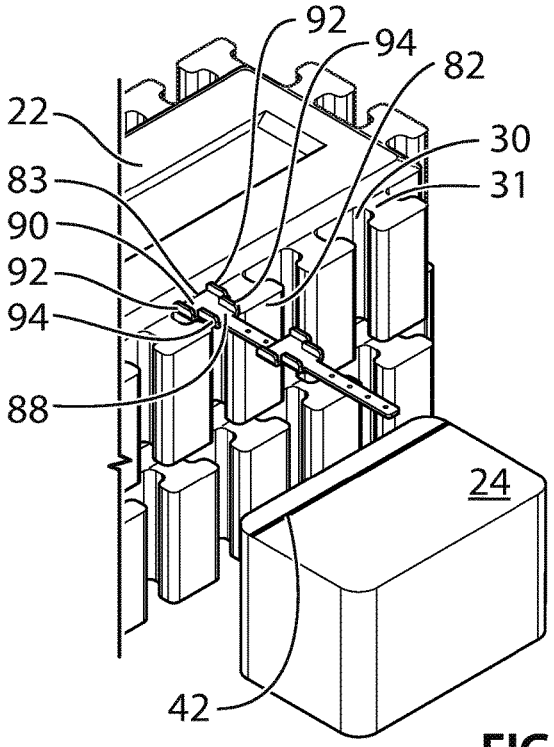
FIG. 7E is a perspective view of rear supporting block arrangements and connectors for providing a configuration of a modular retaining wall system in accordance with a non-restrictive illustrative embodiment of the present disclosure.
Figure 7F:
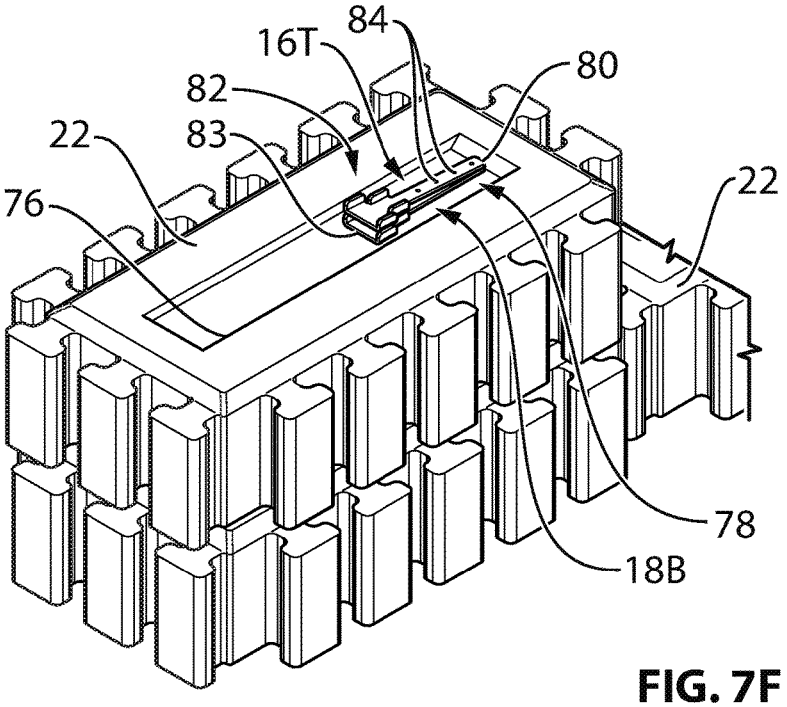
FIG. 7F is a perspective view of rear supporting block arrangements and connectors for providing a configuration of a modular retaining wall system in accordance with a non-restrictive illustrative embodiment of the present disclosure.

With particular reference to FIGS. 7E and 7F, the connector 16 comprises a main longitudinal body defining a front portion 78 towards the front end 80 and a rear portion 82 towards the rear end 83.

The front portion 78 defines a rectangular tab element including apertures 84 for receiving a pin member 86 (see FIG. 7D) for being pinned in the groove 42 of the façade block 24 thereby connecting the connector 16 to the façade block 24. The rear portion 82 includes a first section 88 interposed between a second section 90 of the rear portion 82 and the front portion 78. The second section 90 is wider than the first section 88. The second section 90 includes vertical flaps 92 and the first section 88 includes vertical flaps 94.

As shown in FIGS. 4, and 7A to 7E, the rear portion 82 (including the rear end 83) of the connector 16 is fitted within a slot 30 of the block 22 by inserting it into the top opening 31 of the slot 30 and sliding it downwardly within the slot at a desired height within the slot 30. More specifically, the flaps 94 of the first section 88 engage the side walls 72 of the spaced apart fingers 58 defining the slot 30. The flaps 92 engage side walls 73 as well as shoulders 74 to be wedged therein against forward displacement yet allowing vertical slidable displacement along the slot 30.

FIG. 7E shows that a pair of connectors 16 can be connected together by a fastener through their aligned respective apertures 84, thereby extending the length of the connector element 16.

Figure 9A:
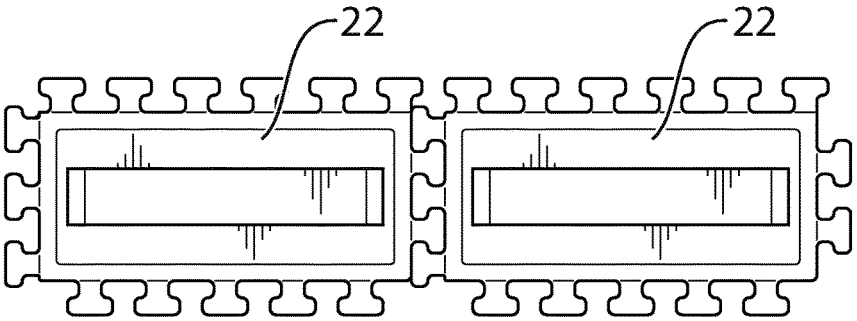
FIG. 9A is a perspective view of an interconnected arrangement of rear supporting blocks for providing a rear supporting wall structure in accordance with a non-restrictive illustrative embodiment of the present disclosure.
Figure 9B:
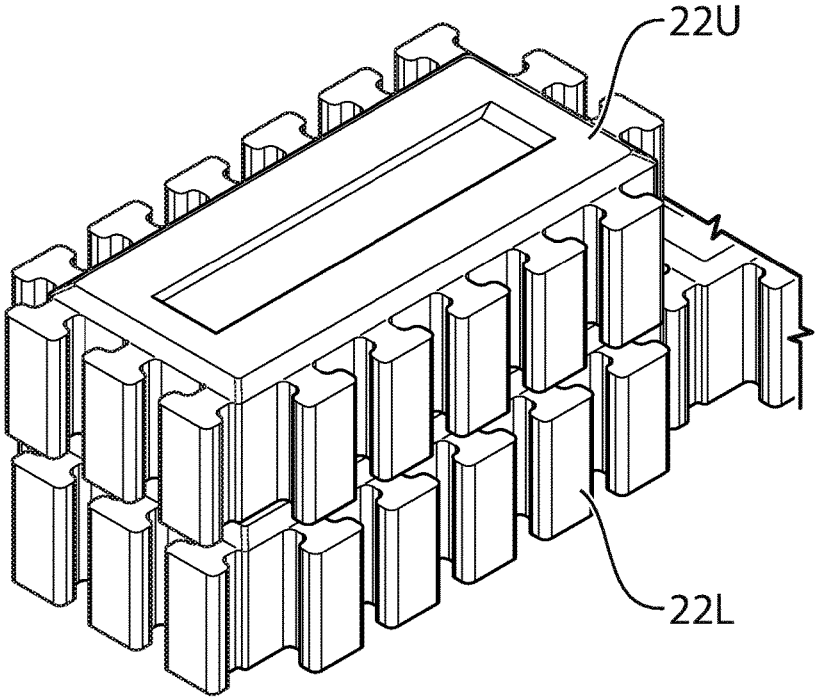
FIG. 9B is a perspective view of an interconnected arrangement of rear supporting blocks for providing a rear supporting wall structure in accordance with a non-restrictive illustrative embodiment of the present disclosure.
Figure 9C:
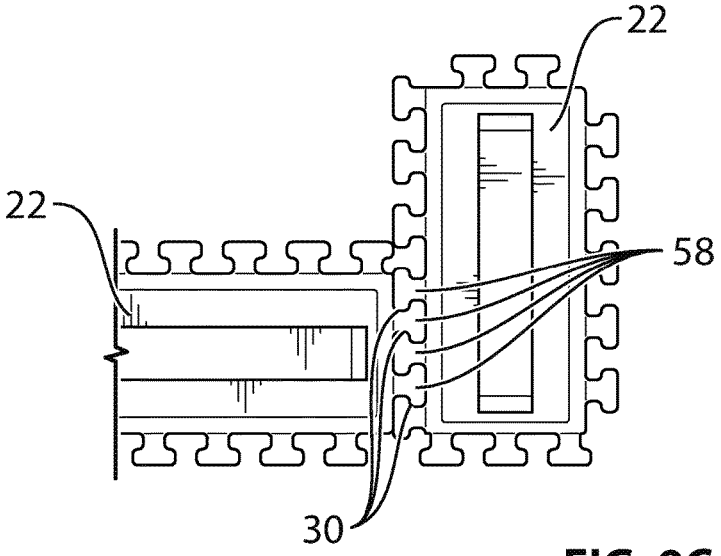
FIG. 9C is a perspective view of an interconnected arrangement of rear supporting blocks for providing a rear supporting wall structure in accordance with a non-restrictive illustrative embodiment of the present disclosure.
Figure 9D:
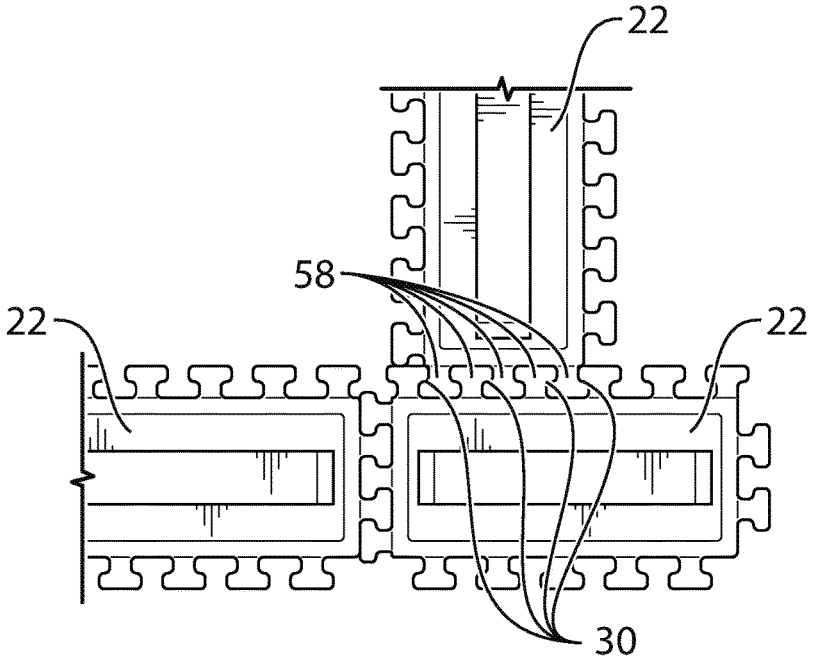
FIG. 9D is a perspective view of an interconnected arrangement of rear supporting blocks for providing a rear supporting wall structure in accordance with a non-restrictive illustrative embodiment of the present disclosure.
Figure 9E:
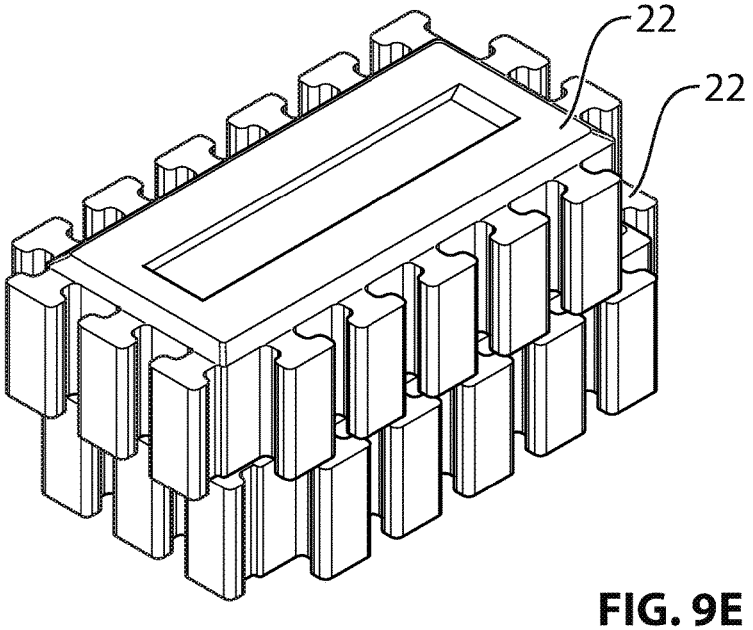
FIG. 9E is a perspective view of an interconnected arrangement of rear supporting blocks for providing a rear supporting wall structure in accordance with a non-restrictive illustrative embodiment of the present disclosure.
Figure 9F:
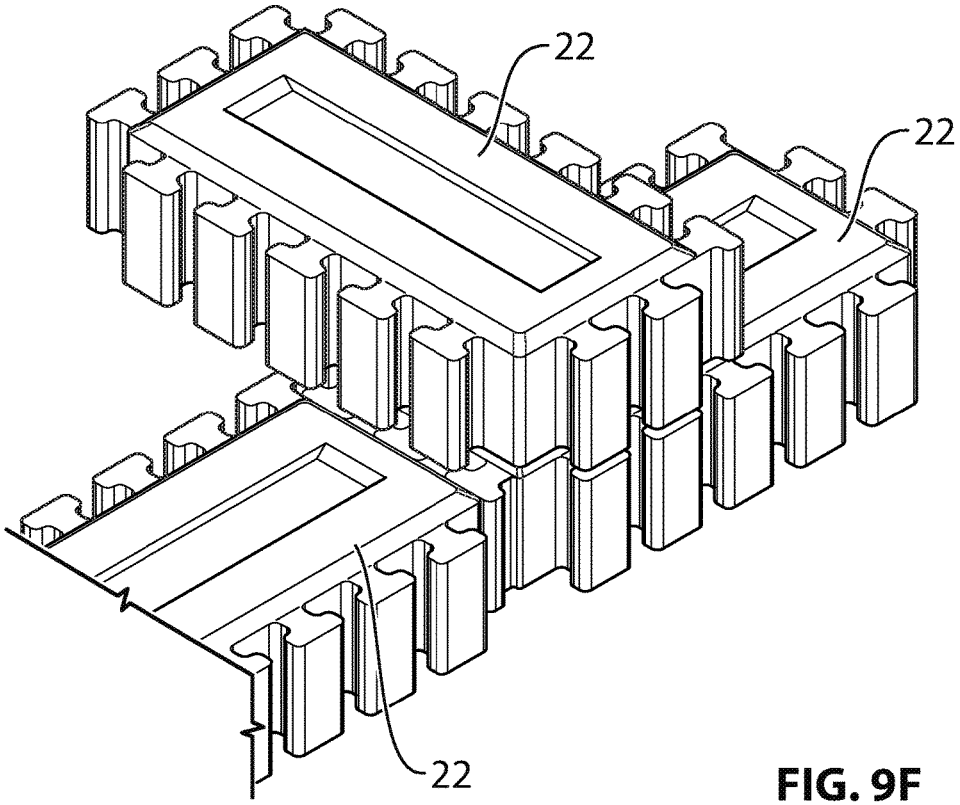
FIG. 9F is a perspective view of an interconnected arrangement of rear supporting blocks for providing a rear supporting wall structure in accordance with a non-restrictive illustrative embodiment of the present disclosure.
Figure 10:
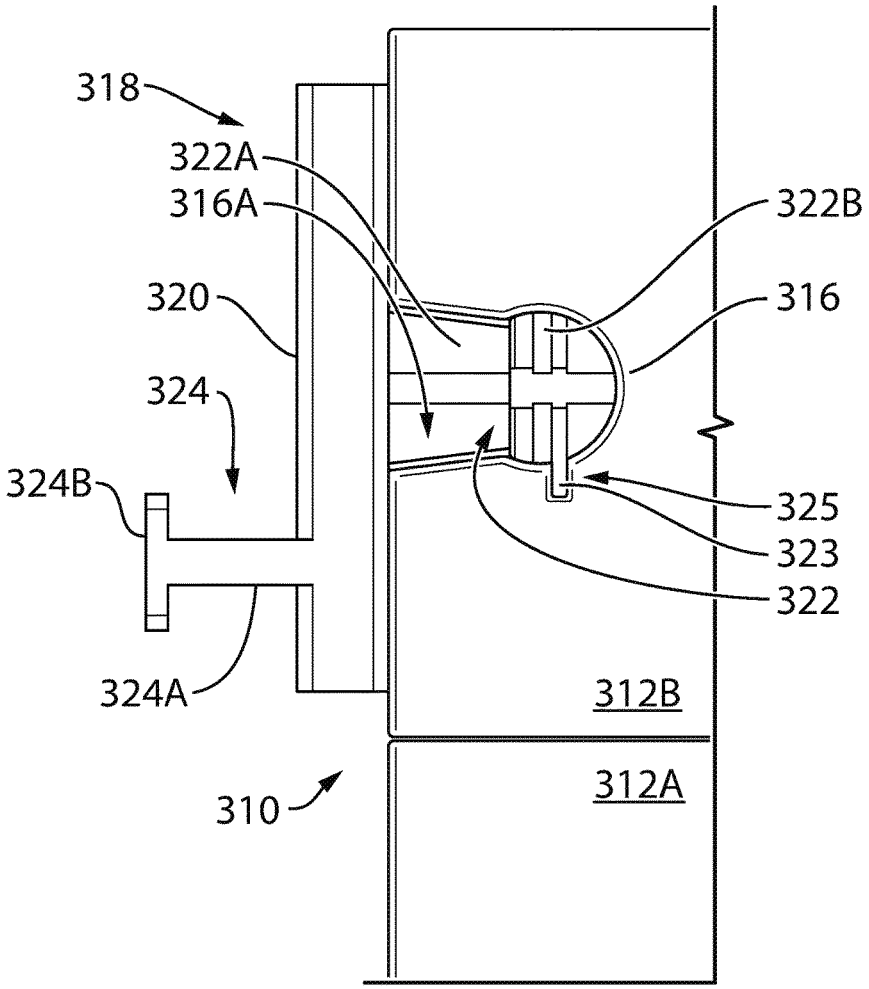
FIG. 10 is a side view of a wall structure including lower and upper blocks and a rear connector in accordance with a non-restrictive illustrative embodiment of the present disclosure.
Figure 11A:
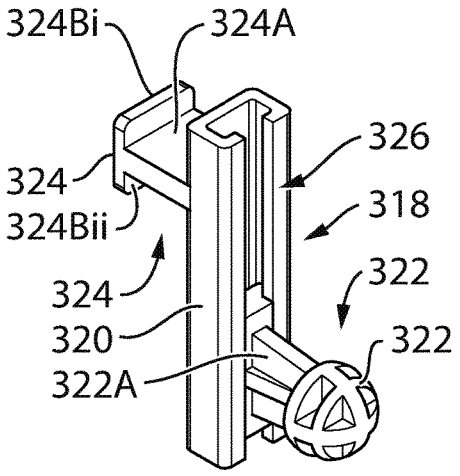
FIG. 11A is a side view of the rear connector shown in FIG. 10 in accordance with a non-restrictive illustrative embodiment of the present disclosure.
Figure 11B:
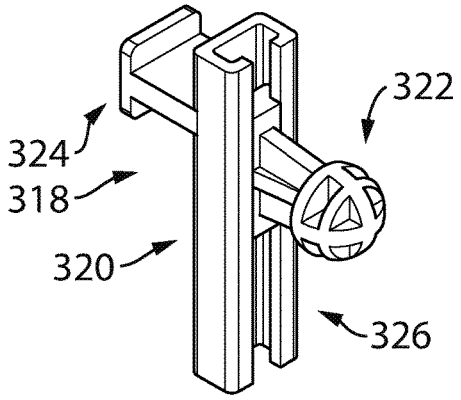
FIG. 11B is a side view of the rear connector shown in FIG. 10 in accordance with a non-restrictive illustrative embodiment of the present disclosure.
Figure 11C:
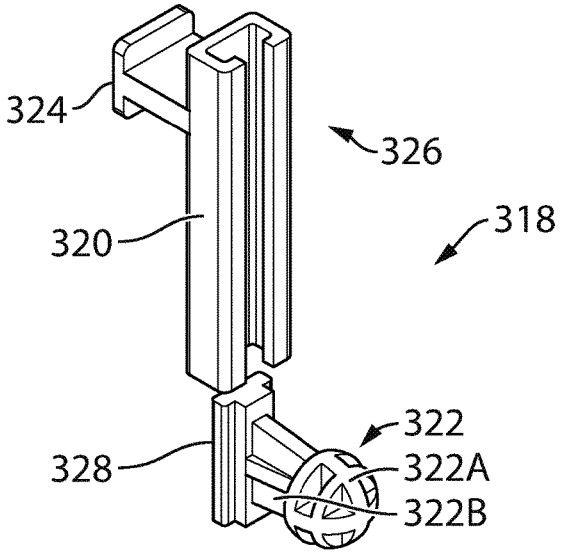
FIG. 11C is a side view of the rear connector shown in FIGS. 11A and 11B in a disassembled position in accordance with a non-restrictive illustrative embodiment of the present disclosure.
Figure 12A:
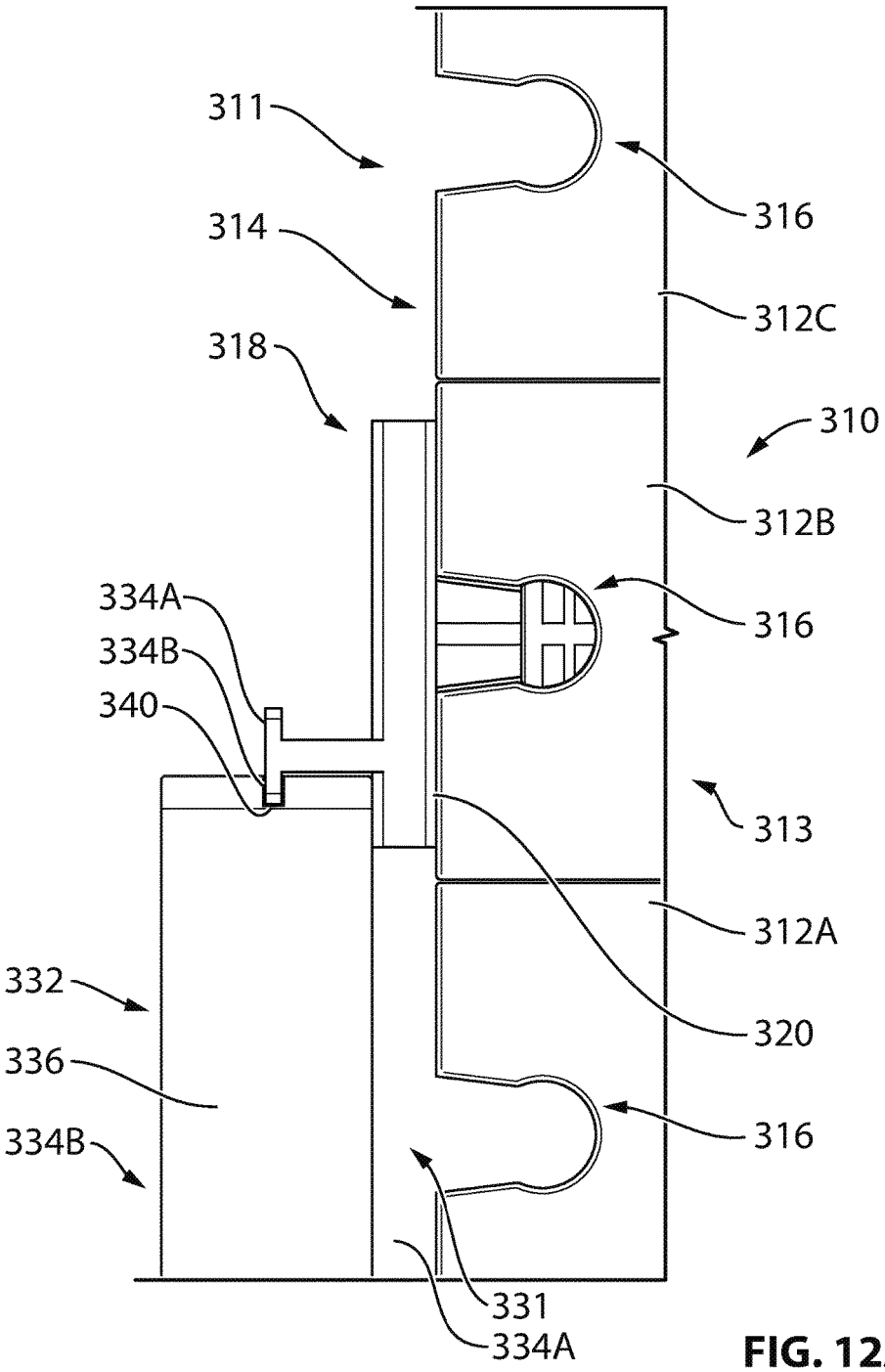
FIG. 12A is a side view of a wall structure including three stacked blocks, a rear connector and a rear support block in accordance with a non-restrictive illustrative embodiment of the present disclosure.
Figure 12B:
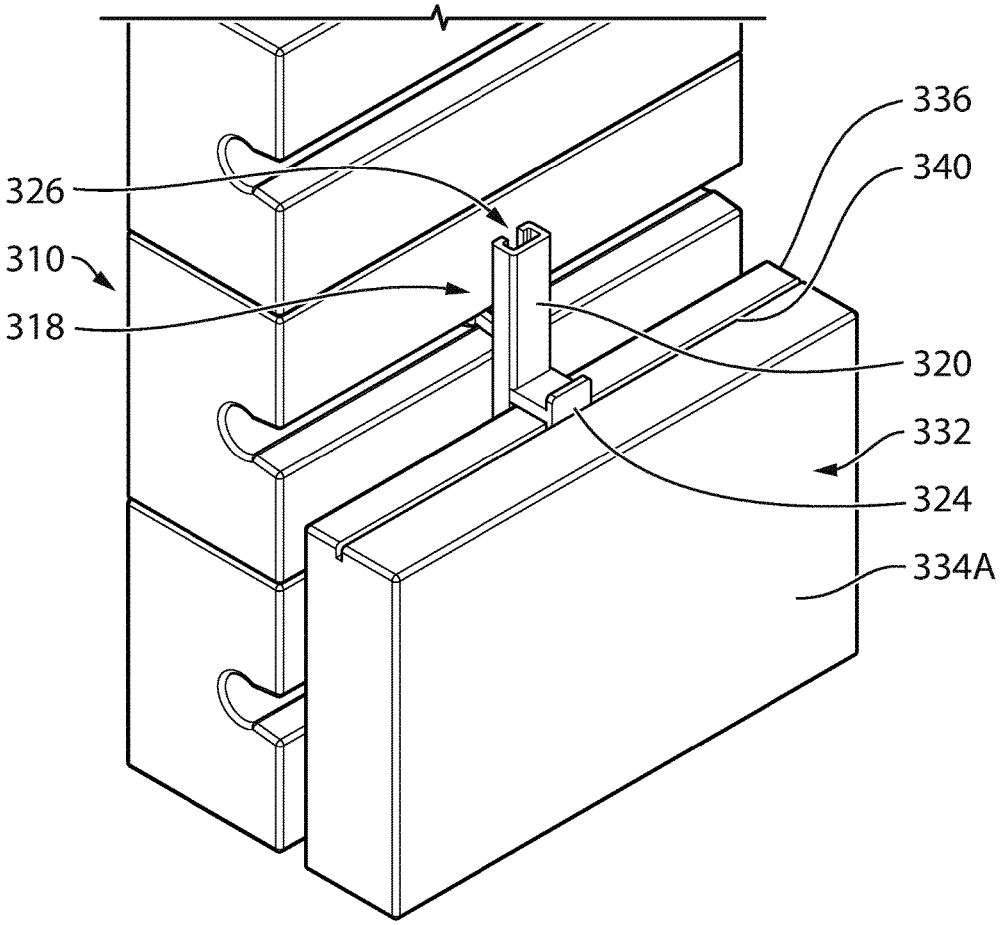
FIG. 12B is a close-up view of the rear connector and the rear support block of FIG. 3A.

FIG. 7F shows a pair of stacked connectors 16 with the bottom connector 16B being positioned face down within the groove 76 and a top connector 16T stacked thereon face up. The top and bottom connectors, 16T and 16B, are offset relative to each other thereby offsetting two stacked blocks 22 such as upper and lower blocks, 22U and 22L shown in FIG. 9B.

Figure 5:
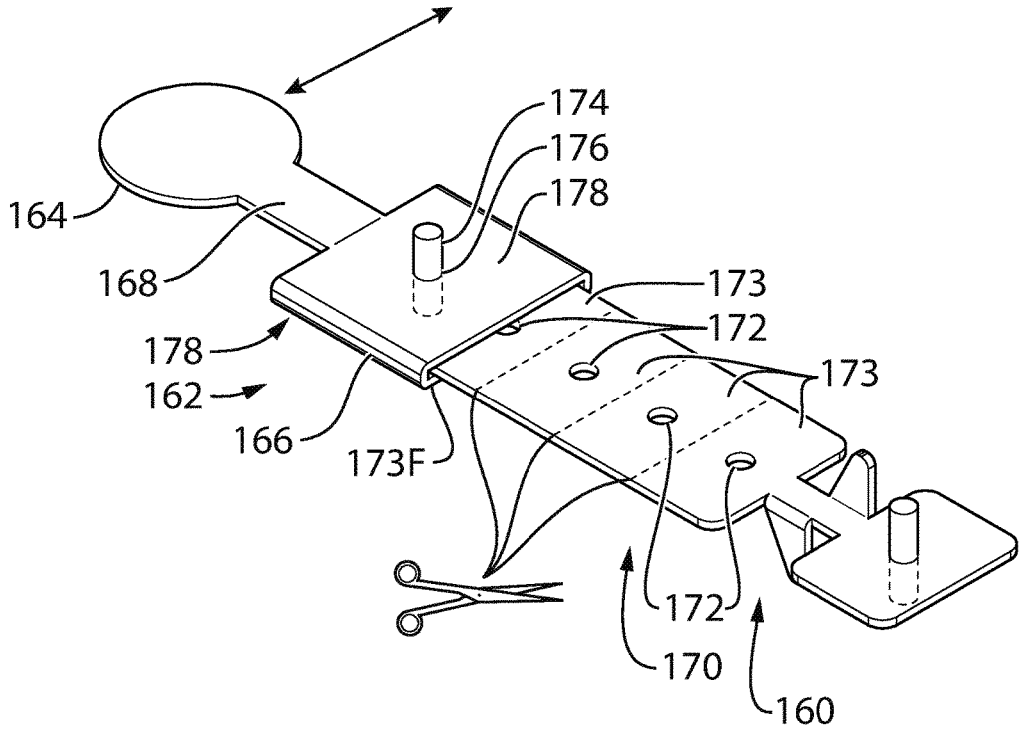
FIG. 5 is a side perspective view of a connector of a modular retaining wall system in accordance with a non-restrictive illustrative embodiment of the present disclosure.

Turning now to FIG. 5, there is show a connector 160 having a rear portion 162 with a tab 164 for being mounted within the slot of a rear supporting block 22. In this example, the slot 30 can have a circular configuration as shown in FIG. 2 for example. The tab 164 extends from a sleeve element 166 via an extension 168. The sleeve element 166 includes an opening for receiving the main body insert 170 of the connector 160. The main body insert 170 includes apertures 172 along its length. The user may cut the main body insert 170 in order to shorten it. In an embodiment, the main body insert 170 includes sections 173 including a respective aperture 172. Once the user cuts off one or more reaming sections, the free end section 173F is inserted within the sleeve element 166 and secured thereto via a fastener 174 being positioned thought the apertures 176 of the top and bottom sheets 178 of the sleeve element 166 which are aligned with the aperture 172 of the free end section 173F. The front portion 180 of the connector 160 includes a tab 182 and wing elements 184 interposed between the tab 182 and the main body insert 170. The tab 182 includes an aperture 186 for receiving a fastener 188 therethrough for connection with the façade block 24 as previously described.

Figures 6A, 6B, 6C:
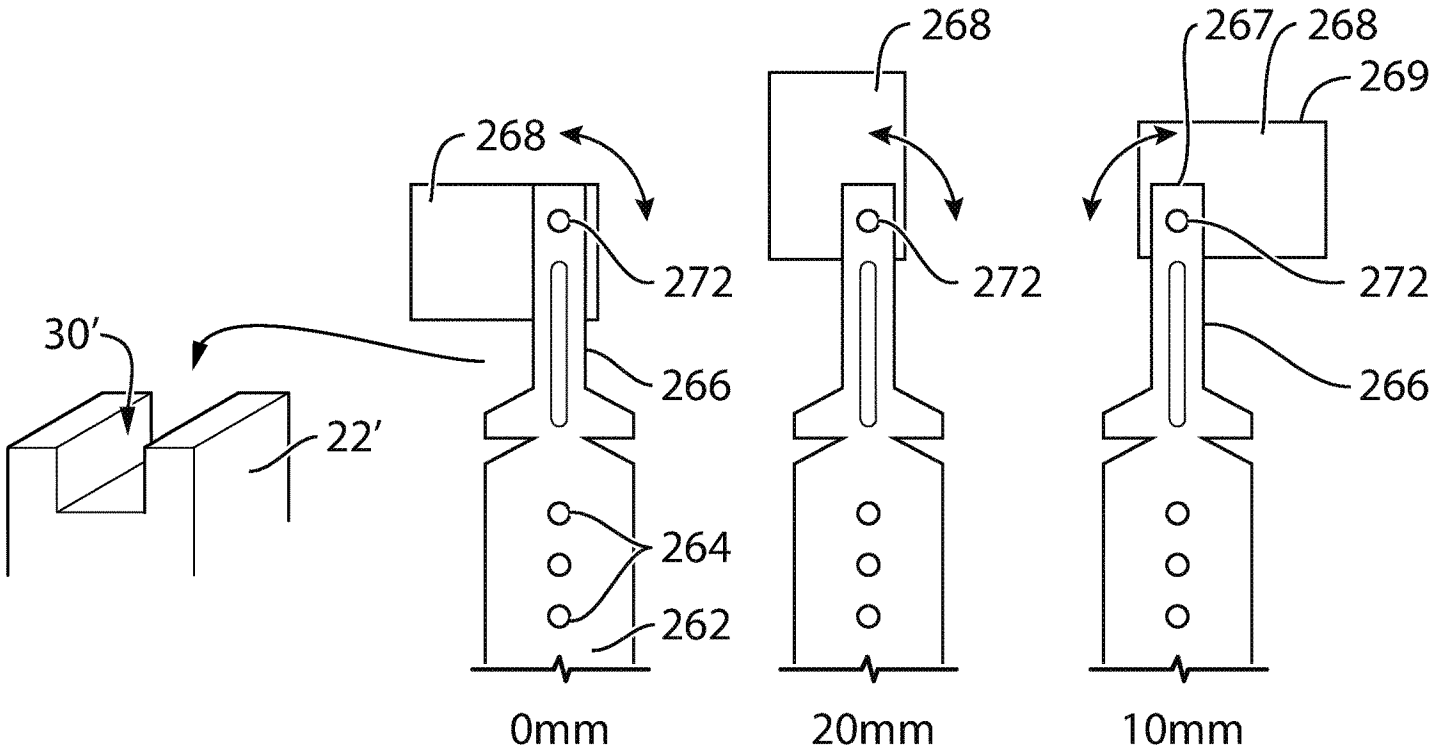
FIG. 6A is a top plan view of a configuration of a rotatable end of a connector of a modular retaining wall system in accordance with a non-restrictive illustrative embodiment of the present disclosure.
FIG. 6B is a top plan view of a configuration of a rotatable end of a connector of a modular retaining wall system in accordance with a non-restrictive illustrative embodiment of the present disclosure.
FIG. 6C is a top plan view of a configuration of a rotatable end of a connector of a modular retaining wall system in accordance with a non-restrictive illustrative embodiment of the present disclosure.

Turning now to FIGS. 6A to 6C, there is shown a connector 260, having a main body 262 with apertures 264 and a rear portion for being connected to a block 22. The rear portion 264 includes an extension 266 with a tab 268 rotatably mounted near the end 270 of the extension 266 at pivot 272. The tab 268 is a square element and rotatable as shown in FIGS. 6A, 6B and 6C to be fitted within different configurations of a slot 30' of a block 22'. Moreover, the distance between the leading edge 267 of the extension 266 and the leading edge 269 of the tab 268 can be adjusted, for example, by a distance of 0 mm shown in FIG. 6A, by a distance of 22 mm in FIG. 6B, by a distance of 10 mm shown in FIG. 6C. Of course, other configurations can provide other distances as the skilled artisan will readily appreciate.

Figure 8A:
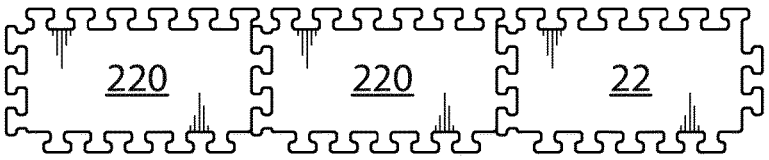
FIG. 8A is a perspective view of an interconnected arrangement of rear supporting blocks for providing a rear supporting wall structure in accordance with a non-restrictive illustrative embodiment of the present disclosure.
Figure 8B:
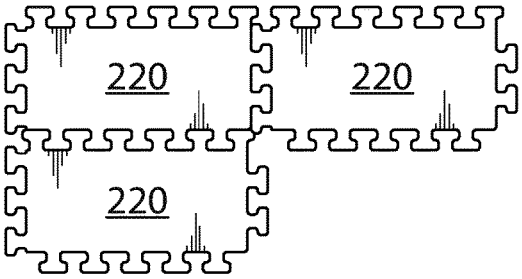
FIG. 8B is a perspective view of an interconnected arrangement of rear supporting blocks for providing a rear supporting wall structure in accordance with a non-restrictive illustrative embodiment of the present disclosure.
Figure 8C:
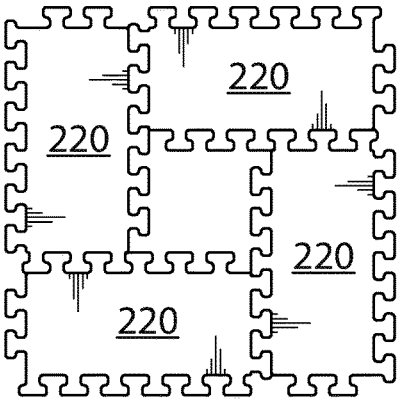
FIG. 8C is a perspective view of an interconnected arrangement of rear supporting blocks for providing a rear supporting wall structure in accordance with a non-restrictive illustrative embodiment of the present disclosure.
Figure 8D:
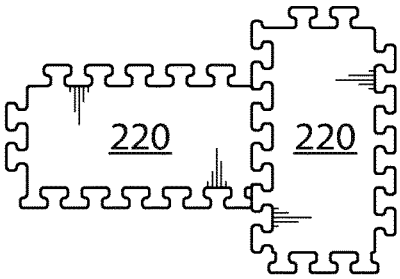
FIG. 8D is a perspective view of an interconnected arrangement of rear supporting blocks for providing a rear supporting wall structure in accordance with a non-restrictive illustrative embodiment of the present disclosure.
Figure 8E:
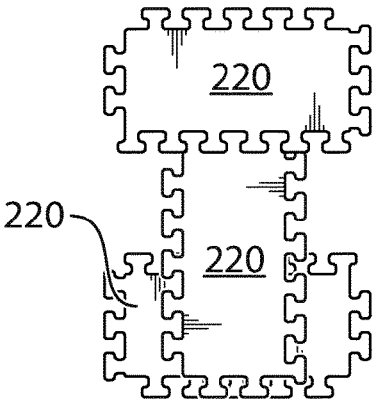
FIG. 8E is a perspective view of an interconnected arrangement of rear supporting blocks for providing a rear supporting wall structure in accordance with a non-restrictive illustrative embodiment of the present disclosure.

In FIGS. 8A to 8B, there is shown different arrangements of interconnected blocks 220 which are shown to have flat non-grooved top and bottom surfaces.

Turning back to FIG. 1, the stacked blocks 22 stacked vertically along the slope of the soil S and the fact that the connectors 16, 160 and 260 can be connected to a façade block 24 at different lengths of the connectors provides for providing a generally vertically straight façade F of the façade wall structure 14 defined by the front faces 32 bocks 24.

FIG. 1 shows a wall structure 10 comprising a lower block 12A and an upper block 12B stacked thereon as is known in the art. As is also known in the art, blocks 12A and 12B have respective front façade faces 13 (see FIG. 3A), respective rear faces 14 (see FIG. 3A), top 15 and bottom 17 end, and opposite lateral sides 19.

As is also known in the art the respective front façade faces 13 of stacked blocks 12A and 12B define the front façade surface 130 of the wall structure 10. As is also well known, the top end 15 of the lower block 12A receives the bottom end 17 of the upper block 12B when stacked thereon. The rear surface 14 (see FIG. 3A) of each respective block 12A and 12B includes a connective element 16. The connective element 16 is shown here in the form of a groove having a first groove portion 16A and a second rearward groove portion 16B. The first groove portion 16A has a rectangular-like configuration and the second groove portion 16B has a circular-like configuration.

With respect to FIGS. 10, and 12A-12C, and 13A there is shown a connector 318 which connects to the rear façade surface of the wall structure 310 and thus acts as a rear connector. A rear connector 318 is mounted to the rear surface 311 of the wall structure 310 formed of blocks 312 which defines a front façade 313. More specifically, the connecter 318 is mounted to the rear surface 314 of the upper block 312B. Of course, in another embodiment the connecter 318 can be mounted to the lower block 312.

The connector 318 includes a main elongate body 320, a first portion 322 thereof extending from the body 320 and an opposite second portion 324 thereof. The first portion 322 provides for connecting to a connective element 316 (shown here in the form of a groove) of a block 312. In the example shown here, the first portion 322 is a protrusion including a rectangular arm 322A and a circular head 322B which respectively connect an outer groove portion 316A and an inner groove portion 316B of the groove 316. The circular head 322B includes an insert 323 for being received by an indentation 325 formed about the groove portion 316B. The second portion 324 is a protrusion including an arm 324A extending from the body 320 carrying a rectangular head 324B. The rectangular head 324B includes an upper tab 324Bi and a lower tab 324Bii. The main body 320 includes a longitudinal groove defining a rail 326 for removably receiving a slider 328 of the first portion 322. In this way, the first portion 322 can be selectively adjusted about the vertical length of the body 320.

Figure 13:
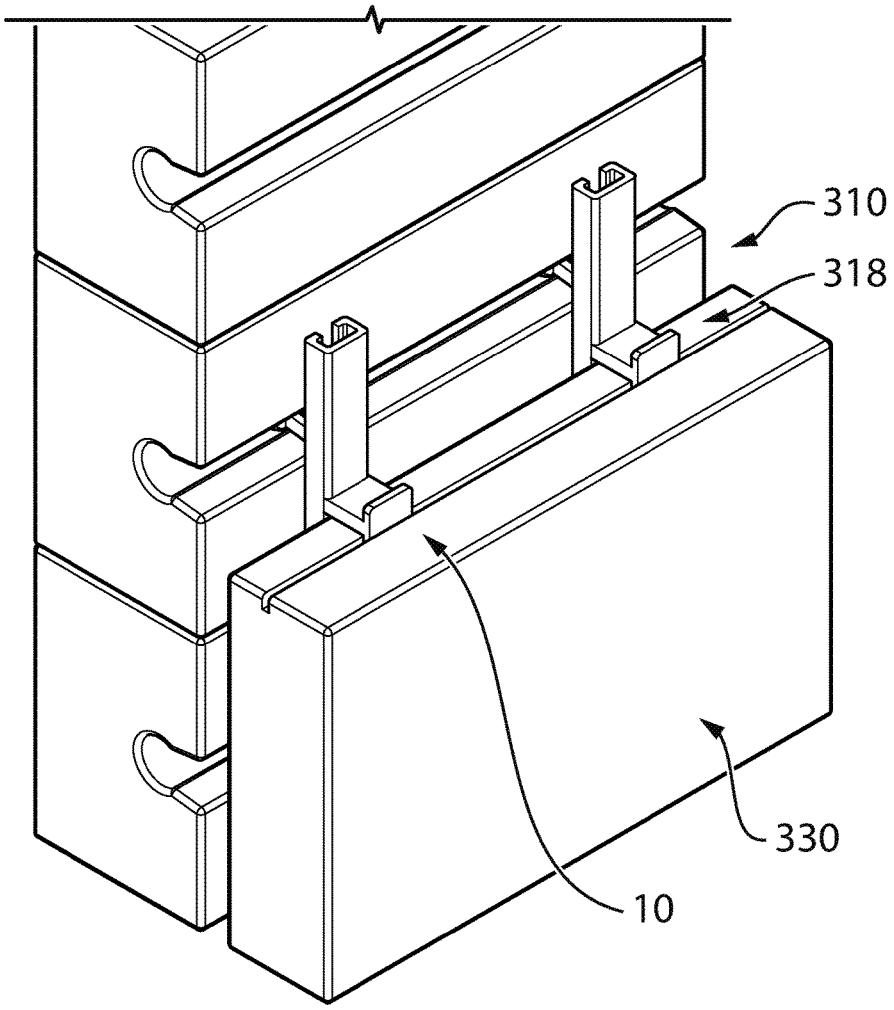
FIG. 13 is a perspective of a lowermost block of a wall structure, a pair of rear connectors connected thereto and to a rear support block in accordance with a non-restrictive illustrative embodiment of the present disclosure.
Figure 14:
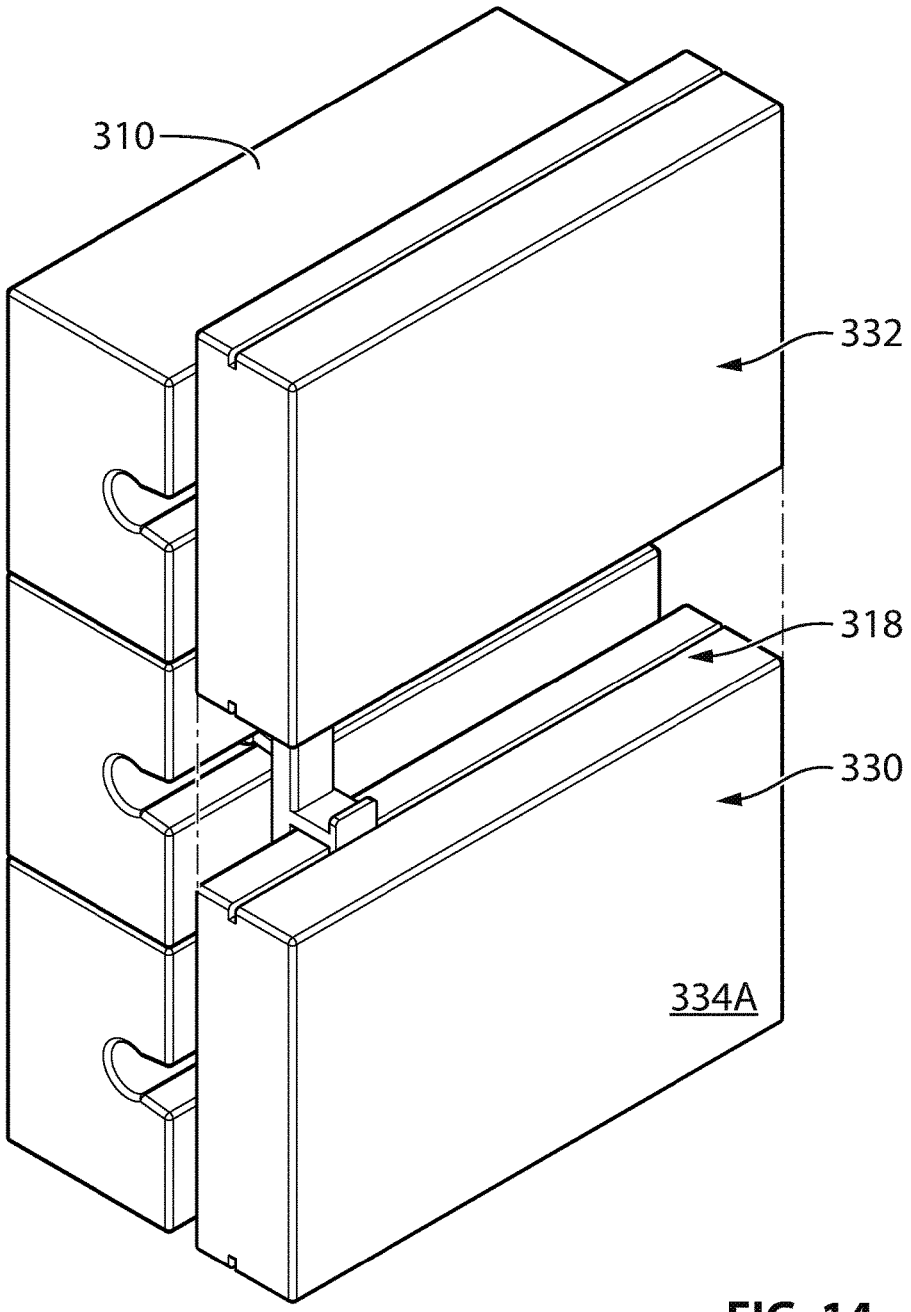
FIG. 14 is a perspective of a wall structure bock, a rear connector connected thereto and to a lower rear support block and an upper rear support block being mounted to the lower rear support block in accordance with a non-restrictive illustrative embodiment of the present disclosure.
Figure 15:
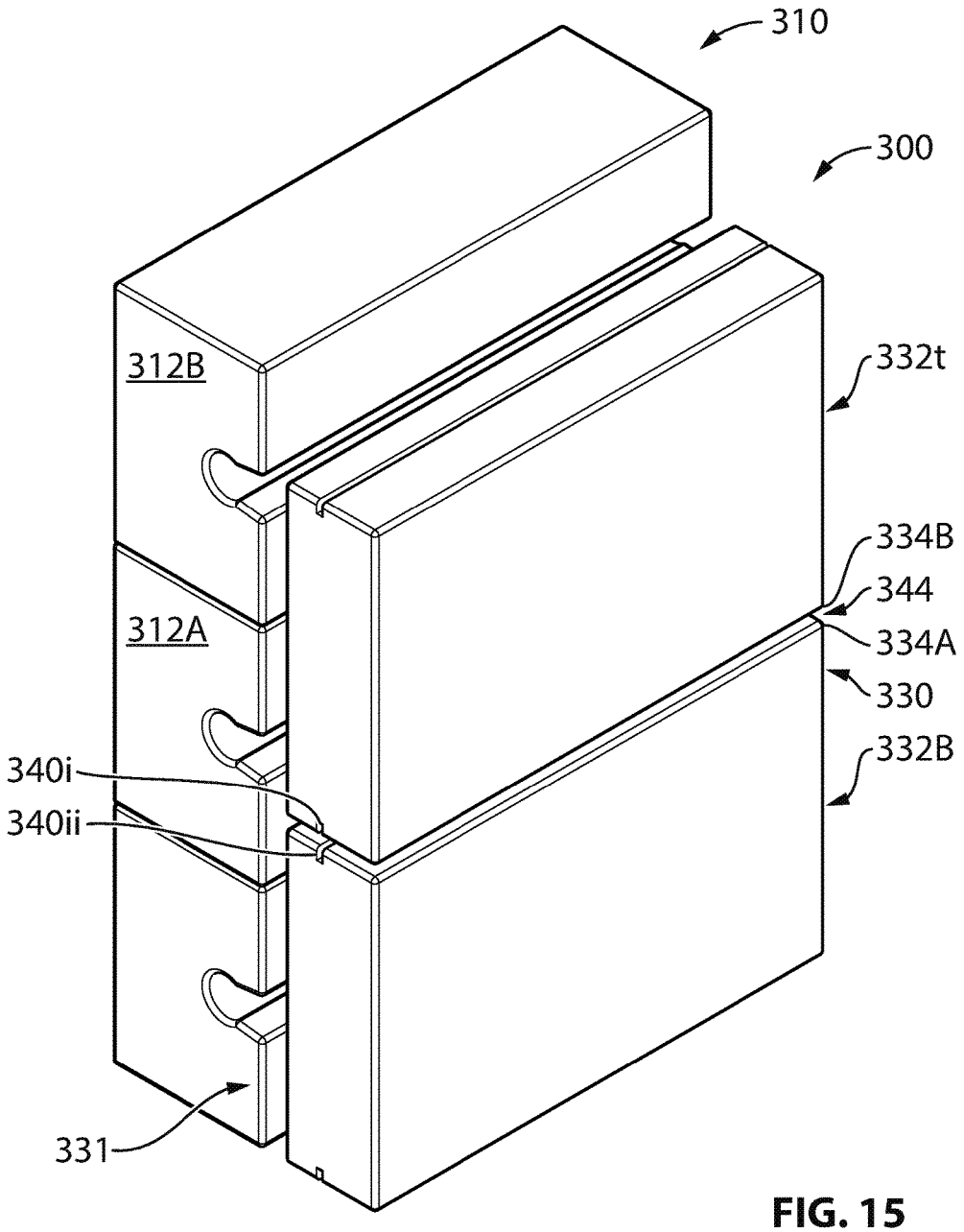
FIG. 15 is a perspective view of a wall structure block connected to a lower rear support block and an upper rear support block being mounted to the lower rear support block in accordance with a non-restrictive illustrative embodiment of the present disclosure.

With reference to FIGS. 13A-13B and 14-18, there is shown a retaining wall structure 330 positioned at the rear side 311 of the block structure 310 and being spaced apart therefrom to define a space 331. In FIG. 13A, there block structure 310 is shown including a three vertically stacked blows, namely and starting from the bottom, a lower block 312A, a median block 312B and an upper block 312C. The wall structure 330 includes blocks 332, a given block 332 define a top end 334A and a bottom end 334B (see FIGS. 15 and 16), lateral sides 336 and front and rear faces, 338A and 338B, respectively.

Each end 334A or 334B includes an elongated slot 340 extending from lateral side 336 to the opposite lateral side 336.

Figure 16:
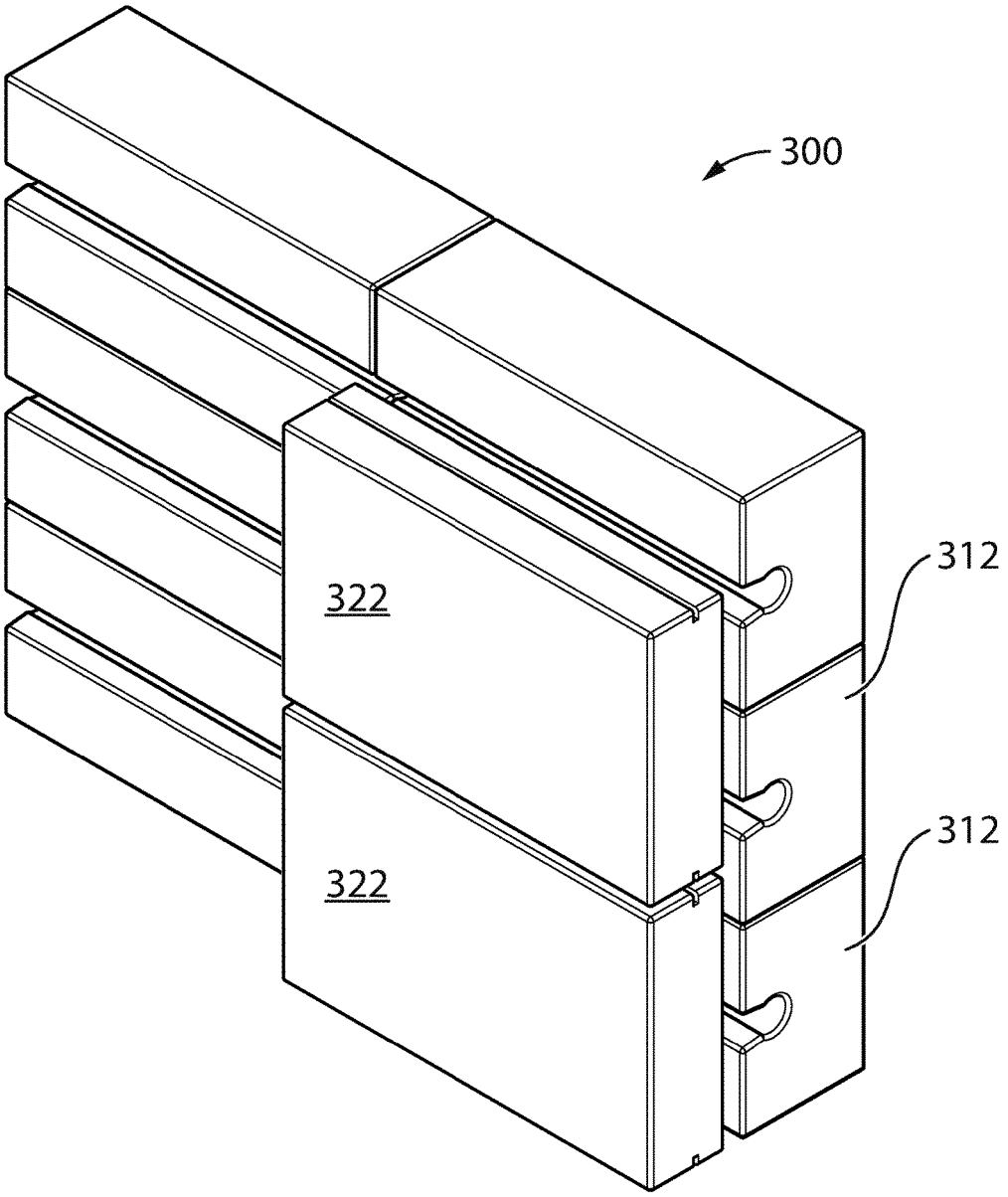
FIGS. 16 and 17 are respective first and second side perspective views of a double modular wall structure including a first wall structure with lower and upper blocks, a second rear wall support structure with lower and upper lower rear support blocks and a rear connector interposed therebetween and interconnected thereto in accordance with a non-restrictive illustrative embodiment of the present disclosure.
Figure 17:
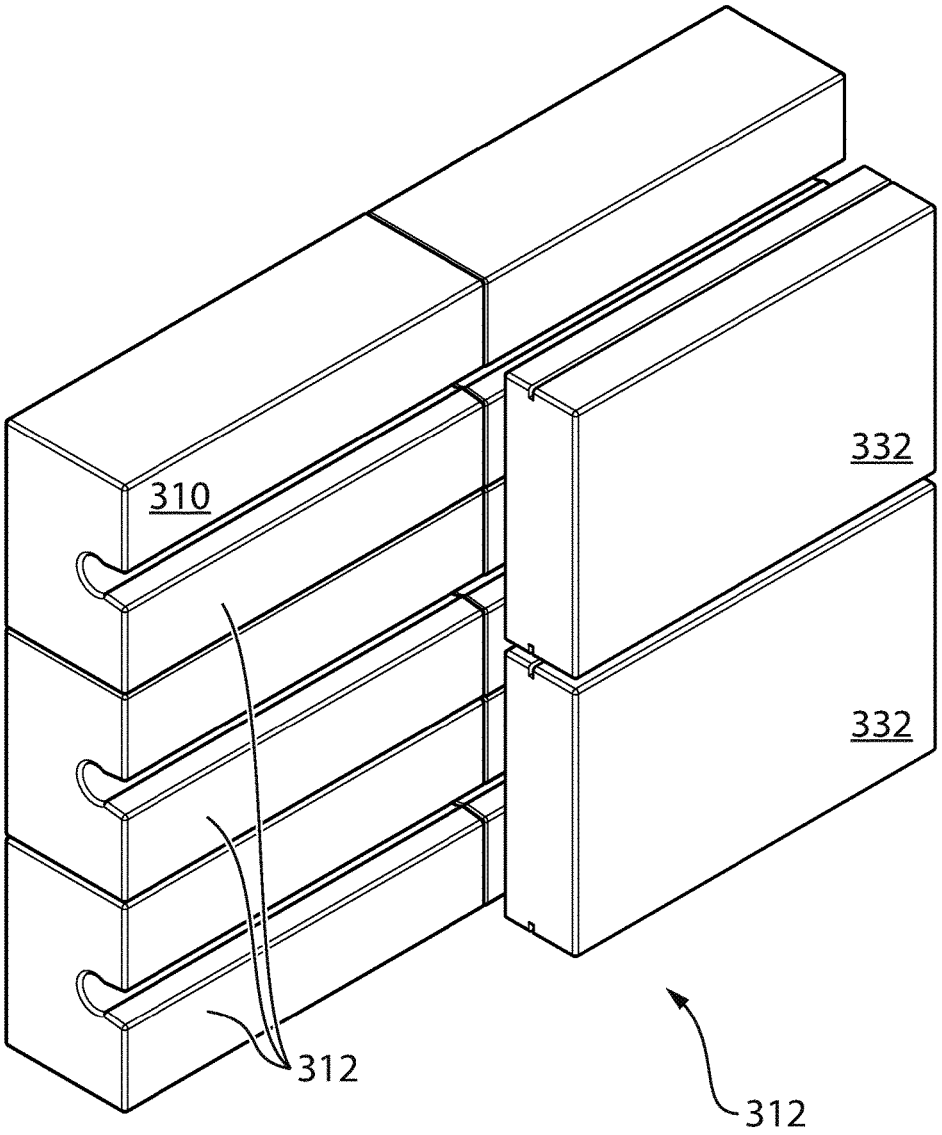
Figure 18A:
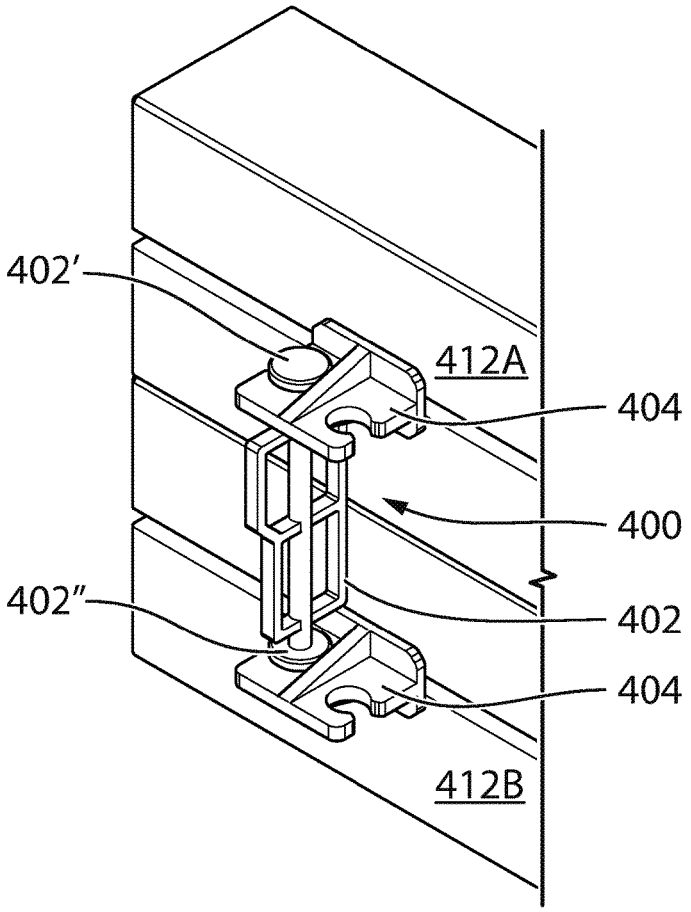
FIGS. 18A and 18B are perspective views of a rear block connector mounted to blocks in accordance with a non-limiting illustrative embodiment of the present disclosure.
Figure 18B:
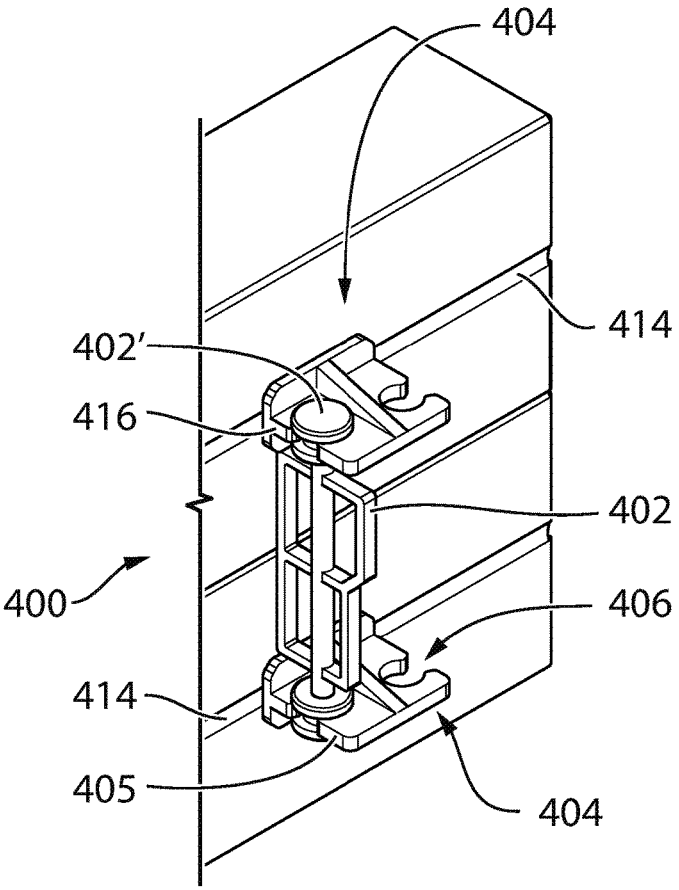
Figure 19:
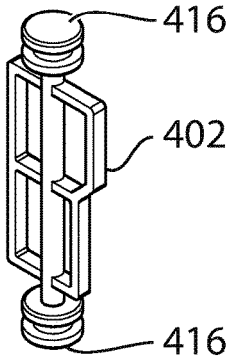
FIG. 19 is a perspective view of the elongated body of the connector of FIGS. 18A and 18B.
Figure 20:
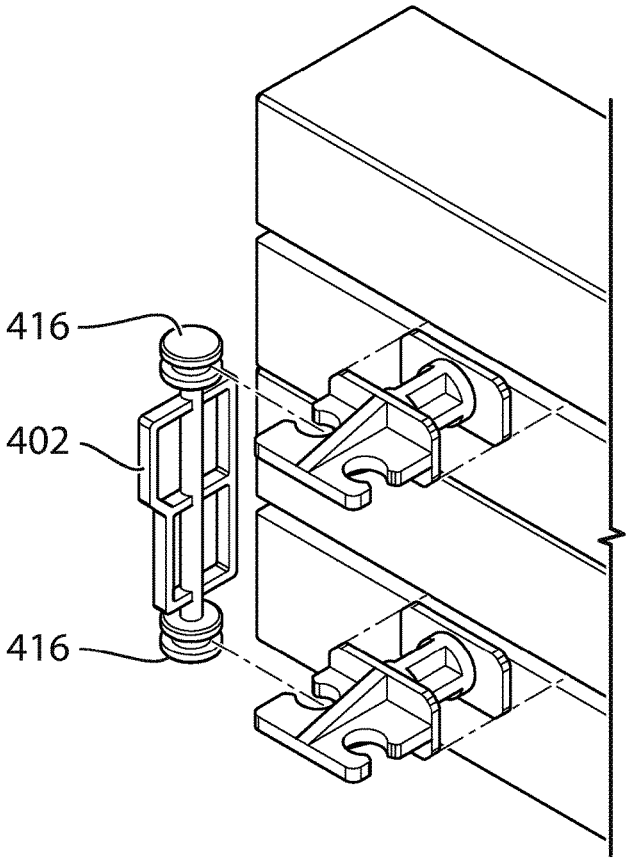
FIG. 20 is a perspective view of the disassembled elongated body and connecting element of the rear block connector of FIGS. 18A and 18B.

With general reference to 13A-13B and 14-18 and particular reference to FIG. 16, a given bottom block 332*b* receives a lower tab 324Bii into its slot 340*ii*, while an upper block 332*t* received an upper tab 32Bii into its upper slot 340*i*. In this way, the upper block 332*t* is stacked on the lower block 332*b* and defines a space 344 therebetween.

Turning now to FIGS. 19A-19B and 20-21, there is shown a connector 400 mounted to upper and lower blocks 412A and 412B for connection therebetween. The connector 400 comprises a main elongate body 402 and a pair of removable connecting elements 404. One of the connecting elements 404 is mounted to a top end 402' of the elongate body 402 and the other connecting element 404 is mounted to the bottom end 402" of the elongate body 402.

The connecting elements 404 are fitted within respective slots 414 defined by the blocks 412A and 412B.

The connecting elements 404 include a rectangular body 405 with c-shaped clamp openings 406 for rotatably receiving a cylindrical support 416 of the main body 402 defined at its top and bottom ends 402' and 402". The connecting elements 404 are rotatable about the supports 416 and can be mounted to rearward retaining wall grooves.

The various characteristics, features and configurations of the various embodiments described herein can be combined in a variety of ways and such it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been described hereinabove by way of embodiments thereof, it can be modified within the scope thereof.

What is claimed is:

1. A retaining wall system comprising:

at least one rear supporting block comprising top and bottom surfaces and a peripheral surface therebetween defining receiving slots on at least a portion thereof, each receiving slot being defined by a backing wall and interfacing side walls, the side walls defining an inner slot section that is wider than an outer slot section defining inner shoulders between the inner and outer slot sections;

at least one façade block comprising front and rear surfaces, top and bottom ends, and lateral sides, the top and bottom ends;

at least one connector comprising:

a rear portion for being fitted into the receiving slot of the rear supporting block;

a front portion for being connected to the top or bottom end of the façade block; and a longitudinal body interposed between the front and rear portions, wherein the front portion defines a tab element including apertures for receiving a pin member for being pinned to the façade block thereby connecting the connector to the façade block, the rear portion comprising a first section interposed between a second section thereof and the front portion, the second section being wider than the first section, the first and second sections comprising respective vertical flaps, the second section providing for being fitted within the inner slot section with the flaps thereof engaging the side walls and the shoulders, the first section providing for being fitted within the outer wall slot section with the flaps thereof engaging the side walls, wherein the connector provides for connecting the façade block to the rear supporting block.

2. A retaining wall system according to claim 1, wherein the slots of the rear supporting block are defined by spaced apart finger portions.

3. A retaining wall system according to claim 2, further comprising at least a second one of the rear supporting block, wherein the slots of the at least one rear supporting block receive the finger portions of the second one of the rear supporting block and wherein the finger portions of the at least one rear supporting block are received by the slots of the second one of the rear supporting block.

4. A retaining wall system according to claim 3, further comprising a plurality of the rear supporting block, wherein a given one of the plurality of the rear supporting block can be connected to another given one of the plurality of the rear supporting block along the respective peripheries thereof.

5. A retaining wall system according to claim 1, wherein the periphery of the rear supporting block comprises front and rear end sides and opposite lateral sides.

6. A retaining wall system according to claim 5, wherein the front, rear and opposite lateral sides define spaced apart finger portions that define the slots of the at least one rear supporting block.

7. A retaining wall system according to claim 1, wherein the distance between the front portion and the rear portion is selectively adjustable in order to selectively adjust the distance between the façade block and the rear supporting block.

8. A retaining wall system according to claim 1, wherein the length of the longitudinal body is selectively adjustable in order to selectively adjust the distance between the façade block and the rear supporting block.

9. A retaining wall system according to claim 1, further comprising at least a second one of the façade block for being stacked at the bottom end thereof on the top end of the at least one façade block thereby defining upper and lower façade block, wherein the front end of the connector is connectable to the bottom end of the upper façade block and the top end of the lowed façade block.

10. A retaining wall system according to claim 1, wherein at least one of the top and bottom ends of the façade block defines a slot, the front end of the connector being fitted within the slot of the façade block.

11. A retaining wall system according to claim 1, wherein the top and bottom surfaces of the rear supporting block define respective grooves for receiving the connector, the system further comprising at least a second one of the rear supporting block stackable on the at least one rear supporting block thereby defining upper and lower rear supporting blocks, wherein the connector is interposable therebetween for providing an offset between the upper and lower rear supporting blocks.

12. A connector for connecting a front façade block to a rear support block, the front façade block having front and rear surfaces, top and bottom ends, and lateral sides, the rear support block having the top and bottom surfaces and a periphery therebetween, a plurality of finger portions protruding from at least a portion of the periphery, a given pair of adjacent fingers having respective interfacing walls that defining a slot therebetween, each receiving slot being defined by a backing wall and interfacing side walls, the side walls defining an inner slot section that is wider than an outer slot section defining inner shoulders between the inner and outer slot sections, the connector comprising:

a rear portion for being fitted within the slot of the rear support block;

a front portion for being mounted to the top or bottom end of the front façade block; and a longitudinal body between the front and the rear portions, wherein the front portion defines a tab element including apertures for receiving a pin member for being pinned to the façade block thereby connecting the connector to the façade block, the rear portion comprising a first section interposed between a second section thereof and the front portion, the second section being wider than the first section, the first and second sections comprising respective vertical flaps, the second section providing for being fitted within the inner slot section with the flaps thereof engaging the side walls and the shoulders, the first section providing for being fitted within the outer wall slot section with the flaps thereof engaging the side walls, wherein the connector provides for connecting the façade block to the rear supporting block.

13. A connector according to claim 12, wherein the distance between the front portion and the rear portion is selectively adjustable.

14. A connector according to claim 12, wherein the length of the longitudinal body is selectively adjustable.

15. A method for providing a retaining wall, the method comprising:

providing at least one rear supporting block comprising top and bottom surfaces and a peripheral surface therebetween defining receiving slots on at least a portion thereof;

providing at least one façade block comprising front and rear surfaces, top and bottom ends, and lateral sides, the top and bottom ends defining respective receiving slots, each receiving slot being defined by a backing wall and interfacing side walls, the side walls defining an inner slot section that is wider than an outer slot section defining inner shoulders between the inner and outer slot sections;

providing at least one connector comprising a rear end for being fitted into the receiving slot of the rear supporting block and a front end for being fitted into the receiving slot of the façade block, wherein the front portion defines a tab element including apertures for receiving a pin member for being pinned to the façade block thereby connecting the connector to the façade block, the rear portion comprising a first section interposed between a second section thereof and the front portion, the second section being wider than the first section, the first and second sections comprising respective vertical flaps, the second section providing for being fitted within the inner slot section with the flaps thereof engaging the side walls and the shoulders, the first section providing for being fitted within the outer wall slot section with the flaps thereof engaging the side walls;

positioning the at least one façade block in front of the rear supporting block;

fitting the rear end of the connector into the receiving slot of the rear supporting block; and connecting the front end to the upper or bottom end the façade block thereby connecting the façade block to the rear supporting block.

* * * * *